US010569926B2

(12) United States Patent
Jackson et al.

(10) Patent No.: US 10,569,926 B2
(45) Date of Patent: Feb. 25, 2020

(54) CORRUGATED CONTAINER WITH BULGE CONTROL

(71) Applicant: Packaging Corporation of America, Lake Forest, IL (US)

(72) Inventors: Keith A. Jackson, Gurnee, IL (US); Nicholas A. Philips, Sugar Grove, IL (US); Benjamin Frank, Buffalo Grove, IL (US)

(73) Assignee: Packaging Corporation of America, Lake Forest, IL (US)

( * ) Notice: Subject to any disclaimer, the term of this patent is extended or adjusted under 35 U.S.C. 154(b) by 39 days.

(21) Appl. No.: 15/635,718

(22) Filed: Jun. 28, 2017

(65) Prior Publication Data

US 2018/0002060 A1 Jan. 4, 2018

Related U.S. Application Data

(60) Provisional application No. 62/356,444, filed on Jun. 29, 2016.

(51) Int. Cl.

| | |
|---|---|
| ***B65D 5/02*** | (2006.01) |
| ***B65D 5/42*** | (2006.01) |
| ***B65D 5/32*** | (2006.01) |

(52) U.S. Cl.

CPC ..... *B65D 5/4266* (2013.01); *B65D 5/029* (2013.01); *B65D 5/32* (2013.01)

(58) Field of Classification Search

CPC ..... B65D 5/029; B65D 5/4266
USPC ..... 229/108, 109, 110
See application file for complete search history.

(56) References Cited

U.S. PATENT DOCUMENTS

| | | | |
|---|---|---|---|
| 2,340,473 | A | 2/1944 | Johnson |
| 3,232,516 | A | 2/1966 | Arslanian |
| 4,702,408 | A | 10/1987 | Powlenko |
| 4,850,506 | A | 7/1989 | Heaps, Jr. et al. |
| 5,178,275 | A | 1/1993 | Fitzgerald et al. |
| 5,738,272 | A | 4/1998 | Anchor et al. |
| 5,921,465 | A | 7/1999 | Garton |
| 6,588,651 | B2 | 7/2003 | Quaintance |
| 6,783,058 | B2 | 8/2004 | Quaintance |
| 7,128,257 | B2 | 10/2006 | Hyatt et al. |
| 7,398,913 | B2 | 7/2008 | McClure |
| 7,654,440 | B2 | 2/2010 | Quaintance et al. |
| 8,025,208 | B2 | 9/2011 | Wisecarver et al. |

(Continued)

FOREIGN PATENT DOCUMENTS

| | | | |
|---|---|---|---|
| GB | 2243596 | A | 11/1991 |
| JP | 2013136412 | A | 7/2013 |

OTHER PUBLICATIONS

Office action dated Jul. 3, 2018, issued by the Canadian Intellectual Property Office in Canadian Patent Application No. CA 2,972,100, filed Jun. 28, 2016 (6 pages).

(Continued)

*Primary Examiner* — Justin M Larson
(74) *Attorney, Agent, or Firm* — Klarquist Sparkman, LLP

(57) ABSTRACT

Wall panels for a corrugated paper board container have bulge control lines formed therein to control the bending of the wall panels as the container is loaded with contents, such as liquid containing contents. The bulge control lines are configured to control the bending of the wall panels to mitigate the possibility of undesirable spouting that makes the containers more difficult to store.

28 Claims, 21 Drawing Sheets

(56) References Cited

U.S. PATENT DOCUMENTS

| | | | | |
|---|---|---|---|---|
| 8,091,768 | B2 | 1/2012 | Wisecarver et al. | |
| 8,448,843 | B2 | 5/2013 | Bettinger et al. | |
| 8,998,070 | B2 | 4/2015 | Wisecarver | |
| 2011/0113733 | A1* | 5/2011 | Franic | B65D 5/029 53/452 |
| 2018/0002060 | A1* | 1/2018 | Jackson | B65D 5/029 |

OTHER PUBLICATIONS

Machine translation of JP 2013136412A.

* cited by examiner

CORRUGATED CONTAINER WITH BULGE CONTROL

CROSS REFERENCE TO RELATED APPLICATION

This application claims the benefit of U.S. Provisional Application Ser. No. 62/356,444, entitled COMBO BIN WITH BULGE CONTROL, filed on Jun. 29, 2016, which is incorporated by reference herein.

TECHNICAL FIELD

This disclosure relates to containers comprising corrugated paper board material, commonly known as combo bins or combos that are often used to hold flowable materials.

BACKGROUND

Combos or combo bins are large open topped containers with a bottom that typically have no flaps or other structure on the top edges. Combo bins are often used to hold flowable material. An example of a combo bin is an open top container that generally fits a conventional pallet of 48"×40" (length by width) pallet.

Flowable material refers to material that may or may not have some liquid content, such as juice, brine or free water that oozes or drips from solid material. Examples include meat, such as ground beef, meat cuts and chicken all of which emit purge, a liquid substance. Pickles in brine would be another example. Other examples include plastic pellets and grains. Combo bins of such flowable materials that contain liquid are subjected to hydraulic pressures from the liquid content in the flowable material. The greater the liquid content, the more flowable the material and the greater the hydraulic forces on the combo bin when filled.

Combo bins often deform in shape due to the forces imposed by their contents being much greater than the bending stiffness of the bin material and relative panel sizes. This is further exacerbated when containers are elongated so that some of the panels are wider than others.

When paper board containers are elongated and exposed to hydraulic forces and/or time, the shape of the container changes. The open top of an empty container initially matches the shape and profile of the bottom of the container. However, as the container is filled, the shape deforms because the top of the container is unconstrained. Though an optimal shape under internal loading is round (the top would "like to become" a circle), the bottom structure adds additional constraints and forces to the wall panels that form the container. Essentially the top of the container has a tendency to become a 90 degree shifted image of the container footprint. When equilibrium is reached, the width of the container at the top may actually end up greater than the length of the container at the bottom due to spouting. The term spouting refers to the buckling of one or more side wall panels of the container along a top edge thereof. Typically, a spout is V-shaped and comprises or consists of a region of progressively decreasing triangular cross section moving downwardly away from the top edge of the buckled side panel. The resulting spout projects outwardly beyond the top edge of the panel that would be present if no spouting takes place. The hydraulic or other forces of the contained product can cause panel buckling or false scores (scores in the form of creases that form on their own due to force or defect), typically near the midpoint, left to right, of a container panel.

The largest width panels buckle or break first and form spouts with subsequent buckling typically in the next largest panels. Often the largest panels only buckle at or near the middle of their width as such buckling creates a significant relief and the remaining sub-panels are too small (relative to the stiffness of the materials) to sub-divide or buckle into additional panels.

This singular buckling or break in the largest width panels can cause the top of the container to flare outward in an angular fashion. This spouting can cause the upper portion of the container to exceed the width of the transportation platform or pallet. This can pose significant challenges when pallets with containers thereon are placed in a confined space, such as on a racking system.

As a specific example, consider the prior art combo bin 8 shown in FIGS. 1-3. With reference to these figures, this combo bin is comprised of a plurality of upright corrugated paper board wall panels that have respective bottom forming panels that are interconnected to form the base or bottom of the bin. The wall panels include first and second end panels 10, 12. End panel 10 is positioned between a first set of diagonal corner panels 14, 16 (panel 16 being formed from two sub-panels 18 and 20 that are glued together). Diagonal or corner panels 22, 24 are formed at the opposite end of the container with wall panel 12 there between. The illustrated container includes opposed side panels 30, 32 that are the widest panels of the combo bin 8. The combo bin is shown on a pallet 33 that can be a conventional pallet that is 40 inches wide by 48 inches long.

The side panels 30, 32 start out as vertical straight or planar side walls when the combo bin is empty. When empty, the illustrated combo bin 8 is an elongated octagonal shape. The end and corner wall panels 10, 14, 16, 12, 22 and 24 can be the same width. Alternatively, they can be of different widths; for example the end wall panels 10 and 12 can be wider than the corner panels. A liner, such as a large plastic bag 40, can be placed in the combo bin for receiving contents deposited in the bag. As the combo bin is filled, the hydraulic pressures (if the contents contain liquid) become greater as the flowable material is added to the bag 40. Eventually the hydraulic forces can reach a level that causes the widest panels, in this case side panels 30, 32, to buckle. This buckling is indicated at locations 42, 44. In effect the side walls 30, 32 end up with an additional fold at these buckling locations. Consequently, the overall width of the combo bin is expanded between the buckling locations.

In effect, a break or crease 42, located approximately in the center of the side panel, subdivides the side panel 30 into respective panels 43 and 45. In addition, the buckle 44 in effect subdivides the side panel 32 into sub-panels 47 and 49.

With reference to FIG. 2, the buckling at 42 thus forms an angular spout at this location in that the upper portion of the combo bin projects outwardly a greater extent at the location of buckle 42. In addition, the buckle 44 causes the panel 32 to form a spout with the upper end of the panel extending outwardly at the location of buckle 44. As a result, the overall width of the combo bin increases and can be greater in width at its widest location than the width of the pallet 33. The width at the widest location can extend a significant distance beyond the adjacent side of the pallet. This creates problems, such as when the pallets are moved to storage locations, as the over width bins can interfere with the ability to place the pallets next to one another or in racks.

With reference to FIG. 3, a spout 42 is shown from a side elevation perspective. Respective dashed lines 50, 52 are illustrated for purposes of explanation. In general, as the side wall 30 tends to fail, initial buckling appears to happen along respective lines 50 and 52 that are typically at respective angles A and B relative to the bottom edge 53 of the side panel 30. Angles A and B typically range from about 30 to 45 degrees, but can vary depending upon the failure of the container due to hydrostatic hydraulic forces.

There have been various attempts to address the change in shape of these types of containers. The most historically common approach uses bands and/or internal tape built into the structure of the corrugated paper board. These materials do not control the shape of the container per se, but do attempt to constrain the growth in the circumference of the container and thus restrict some of the more severe deformations. However, because the stretch of many of these band materials is on the order of or greater than the stretch of the paper board forming the container, they typically do not effectively limit the spouting type behavior of combo bins.

FIG. 4 illustrates a combo bin with two lower bands or straps 60, 62 and one upper band or strap 64. For convenience, the various wall panels in the embodiment of FIG. 4 have been assigned the same numbers as in FIG. 1. As can be seen in FIG. 4, the straps 60, 62 and 64 did not prevent the buckling at 42 and 44 and the corresponding spouts at the upper ends of the combo bin at these buckling locations. One reason that bands do not help is that the overall perimeter of the upper portion of the combo bin does not dramatically increase as the combo bin is filled, but primarily changes shape.

Another approach does not attempt early control of the bulge. Instead, the combo bin is left to deform in an uncontrolled fashion until an upper parabolic score, extending from upper corner to upper corner of the widest panel, tries to impede the formation of the spout. This upper parabolic score is positioned above the horizontal center line of the combo bin. This presents several problems. The uncontrolled nature of the start reduces the reliability that the parabolic score will actually mitigate the spout formation and thus reduce the overall combo width. Secondly the size of the resulting panel lends itself to subsequent fracture from hydraulic forces and spouting even if it initially performs as desired. Thirdly the upper parabolic score is limited in elongation aspect ratio, which is exacerbated by increasing panel widths.

Therefore, a need exists for a combo bin with structures that control the deformation of side walls of a combo bin, particularly when they are filled with a flowable material that exerts hydraulic pressures on the side walls. These and other aspects of this disclosure will become apparent from the description below and accompanying drawings.

SUMMARY

In accordance with an aspect of this disclosure, bulge control scores, also called bulge control lines, are provided wall panels, such as the largest width panels, of a combo bin prior to any filling. These bulge control scores subdivide the side wall panels into a plurality of upright sub-panels that form as a container is filled and bulges out. The bulge control scores can be formed by weakening the side walls of the container (typically the largest width side walls, width meaning the distance in a horizontal direction when the wall panels are in an upright orientation) along which bulging is to be controlled. In one example, this weakening can be provided by forming score lines such as compression lines in a surface of a plurality of side wall panels of a container comprising corrugated paper board. One or more additional container walls in addition first and second side walls can be provided with bulge control lines. The bulge control lines are designed to mitigate the risk of spouting of the wall panels having the bulge control lines.

In accordance with another aspect of this disclosure, an embodiment of a container comprising corrugated paper board can comprise: first and second side wall panels opposed to one another, the container comprising a plurality of other wall panels other than the first and second side wall panels which other wall panels together with the first and second side wall panels are coupled together and form the walls of the container. A bottom or base portion is coupled to the first and second side wall panels and to the other wall panels of the container. In addition, the first and second side wall panels can each comprise a panel body including a bottom edge, a top edge, a center between the bottom edge and the top edge, and first and second side edges. Each panel body can comprise a plurality of bulge control lines that extend from a first location at or adjacent to the bottom edge of the panel body to a second location at or adjacent to the top edge of the panel body, the bulge control lines subdividing the panel body into at least three subpanels, the bulge control lines extending from the first location to a second location adjacent to the to the top edge of the panel body, and wherein the bulge control lines are further apart at the first location than at a third location that is above the first location. As alternative aspects of this embodiment, the third location is between the first location and the second location and can be about at a horizontal center line of the panel body, the horizontal center line extending through the center of the panel body; the third location comprises a region of the panel body that extends from below to above the center of each panel body and/or from below to above the horizontal centerline of the panel body; the subpanels comprise a subpanel with portions positioned on opposite sides of a vertical centerline through the center of the panel body; the first and second bulge control lines are spaced from the vertical centerline of the panel body; the first and second bulge control lines are about equally spaced from the vertical centerline of the panel body; and/or the first and second bulge control lines are symmetric about the vertical center line of the panel body.

As another aspect, container walls of a container comprising corrugated paper board, such as opposed first and second container side walls, can comprise a panel body comprise first and second bulge control lines, the first bulge control line comprising a first bulge control line section below the center of the panel body and the second bulge control line comprising a second bulge control line section below the center of the panel body, wherein the first and second bulge control line sections converge along a least a portion of the length of the respective first and second bulge control line sections moving away from the bottom edge and upwardly toward the center of the container. In addition, the first and second bulge control line sections can be arcuate. The first bulge control line comprises a third bulge control line section above the center of the panel body and the second bulge control line comprises a fourth bulge control line section above the center of the panel body. The third and fourth bulge control line sections can diverge along at least a portion of the length of the of the respective third and fourth bulge control line sections moving away from the center and toward the top edge. The third and fourth bulge control line sections can alternatively be straight, such as parallel to one another, or arcuate.

As yet another aspect, an embodiment of a container can have first and second walls, such as side walls comprising a panel body with respective first and second bulge control lines. More than two upright bulge control lines can also be included with the first and second bulge control lines in one or both of the side walls. The panel body can comprise first, second, third and fourth corners, the first corner being at the intersection of the of the first side edge and the bottom edge, the second corner being at the intersection of the second side edge and the bottom edge, the third corner being at the intersection of the first side edge and the top edge and the fourth corner being at the intersection of the second side edge and the top edge. In addition, the first bulge control line of each panel body can have a first section that extends upwardly and from the first corner and the second bulge control line of each panel body can have a second section extends upwardly from the second corner.

As a further aspect, a container comprising corrugated paper board can comprise the first and second bulge control lines in panel bodies of one or more wall panels that are arcuate, are spaced apart from one another at the center of the panel body and that extend from a location at or adjacent to a bottom edge of the panel body to a location at or adjacent to the top edge of the panel body.

As a still further aspect, a container comprising corrugated paper board comprises first and second wall panels each having a panel body, first and second side edges, a bottom edge and a top edge; wherein each panel body comprises first and second bulge control lines, the first bulge control line extending upwardly from a first bulge control line first location to a first bulge control line second location, the second bulge control line extending upwardly from a second bulge control line first location to a second bulge control line second location, each panel body further comprising first, second, third and fourth corners, the first corner being at the intersection of the of the first side edge and the bottom edge, the second corner being at the intersection of the second side edge and the bottom edge, the third corner being at the intersection of the first side edge and the top edge and the fourth corner being at the intersection of the second side edge and the top edge, wherein first bulge control line first location is at or adjacent to the first corner and the first bulge control line second location is at or adjacent to the top edge, and wherein the second bulge control line first location is at or adjacent to the second corner and the second bulge control line second location is at or adjacent to the top edge. The first bulge control line second location can be spaced inwardly along the top edge of the panel body from the third corner and the second bulge control line second location can be spaced inwardly along the top edge of the panel body from the fourth corner.

As a further aspect, containers comprising corrugated paper board can have first and second walls with respective first and second bulge control lines that are mirror images of one another.

As another aspect, the bulge control lines can be formed can be formed in the interior surfaces of respective wall panel bodies of containers comprising corrugated paper board.

In accordance with an exemplary embodiment, a container comprising corrugated paper board can comprise first and second side wall panels that are wider than the other wall panels of the container, the first and second side wall panels comprising respective first and second bulge control lines and the other panels can be provided without bulge control lines.

In accordance with another aspect of this disclosure, an embodiment of a container comprising corrugated paper board can comprise: first and second side wall panels opposed to one another, the container comprising a plurality of other wall panels other than the first and second side wall panels which other wall panels together with the first and second side wall panels are coupled together and form the walls of the container. A bottom or base portion is coupled to the first and second side wall panels and to the other wall panels of the container. In addition, the first and second side wall panels can each comprise a panel body including a bottom edge, a top edge, a center between the bottom edge and the top edge, and first and second side edges. Each panel body can comprise a plurality of bulge control lines that extend from a first location at or adjacent to the bottom edge of the panel body to a second location at or adjacent to the top edge of the panel body, the bulge control lines subdividing the panel body into at least three subpanels, the bulge control lines extending from the first location to a second location adjacent to the to the top edge of the panel body, and wherein the bulge control lines are further apart at the first location than at a location that is above the first location. The other wall panels can include four corner wall panels each with first and second corner wall panel side edges, and first and second end wall panels each with first and second end wall panel side edges, a first of the corner wall panels having its first corner panel side edge connected a the first side edge of the first side wall panel and its second corner panel side edge connected to the first side edge of the first end wall panel, a second of the corner wall panels having its first corner panel side edge connected to a second side edge of the first side wall panel and its second corner panel side edge connected to the first end wall side edge of the second end wall panel, a third of the corner panels having its first corner panel side edge connected to a first side edge of the second side wall panel and its second corner panel side edge connected to the second side edge of the first end wall panel, and a fourth of the corner panels having its first corner panel side edge connected a the second side edge of the second side wall panel and its second corner panel side edge connected to the second end wall side edge of the second end wall panel, wherein the first and second side wall panels have a greater width than the width of the first and second end wall panels. The first and second end wall panels can also have a greater width than each of the four corner wall panels. As a further aspect, the first and second bulge control lines can be spaced apart such that the width between the first and second bulge lines at the center of the wall panels is not greater than the width of the end wall panels. Alternatively, the width between the first and second bulge control lines at the center of the wall panels can also be not greater than the width of the corner wall panels. The width of the subpanel between the first and second of the bulge control lines at the center of the first and second wall panels can also be no greater than the width of the first and second end wall panels. Alternatively, the width of the subpanel between the first and second bulge control lines can be no greater than the width of each of the four corner panels.

As a further aspect, a container comprising corrugated paper board with wall panels comprising the first and second bulge lines can comprise a base of bottom portion that comprises a plurality of bottom flap panels extending from lower edges of the wall panels of the container, such as from lower edges of the side wall panels, end wall panels and the corner panels.

As a still further aspect, a container comprising corrugated paper board can comprise wall panels, such as side wall panels, the end wall panels, and the corner panels, first and second wall panels having the bulge control lines and wherein the wall panels form a tubular container wall structure, and further comprising a base or bottom portion that comprises a base coupled to the tubular wall structure.

As yet another aspect, a container comprising corrugated paper board with wall panels comprising the first and second bulge control lines can be formed from a one piece blank wherein the blank comprises first and second side wall panels with the bulge control lines together with the other wall panels of the container. The one piece blank can include bottom or base forming panel sections. As an alternative aspect, the one piece blank can form the wall panels of the container and a second one piece blank can be used to form the base or base portion of the container.

In accordance with a still further aspect, an embodiment of a container comprising corrugated paper board can comprise: first and second side wall panels opposed to one another and that are in respective first and second planes, the container comprising a plurality of other wall panels other than the first and second side wall panels which other wall panels together with the first and second side wall panels are coupled together and form the walls of the container; a bottom or base portion coupled to the first and second side wall panels and to the other wall panels; and wherein the first and second side wall panels each comprise means for subdividing the side wall panel into at least three upright subpanels that bulge out from the respective first and second planes and that extend from the bottom to the top of the container as the container is filled with contents.

As still further aspects, this disclosure encompasses individual wall panels with bulge control lines with all combinations and sub-combinations of the bulge control line aspects described above. In addition, this disclosure encompasses containers having all combinations and sub-combinations of the above described aspects.

In accordance with an aspect, one specific embodiment of a wall panel for a container comprising corrugated paper board comprises: a panel body comprising corrugated paper board including a bottom edge, a top edge, a center between the bottom edge and the top edge, and first and second side edges; the panel body comprising a plurality of bulge control lines that extend from a first location at or adjacent to the bottom edge of the panel body to a second location at or adjacent to the top edge of the panel body, the bulge control lines subdividing the panel body into at least three subpanels that extend from a location adjacent to the bottom edge of the panel body to a location adjacent to the to the top edge of the panel body; and wherein the bulge control lines comprise first and second bulge control lines, the first bulge control line comprising a first bulge control line section below the center of the panel body and the second bulge control line comprising a second bulge control line section below the center of the panel body, wherein the first and second bulge control line sections converge along a least a portion of the length of the respective first and second bulge control line sections moving away from the bottom edge and upwardly toward the center of the container. As another aspect, the bulge control lines comprise at least the first and second bulge control line sections are arcuate.

As additional aspects, the panel body can first, second, third and fourth corners, the first corner being at the intersection of the of the first side edge and the bottom edge, the second corner being at the intersection of the second side edge and the bottom edge, the third corner being at the intersection of the first side edge and the top edge and the fourth corner being at the intersection of the second side edge and the top edge, wherein the first bulge control line section extends upwardly from a first location at or adjacent to the first corner and the second bulge control line section extends upwardly from a second location at or adjacent to the second corner.

As a further aspect, the wall panel comprises an interior surface which faces the interior of a container with the wall panel, the first and second bulge control lines being formed in the interior surface of the wall panel.

These and other aspects of containers and wall panels with bulge control lines will become apparent with reference to the description below and the Figures.

DETAILED DESCRIPTION

Figure 1:
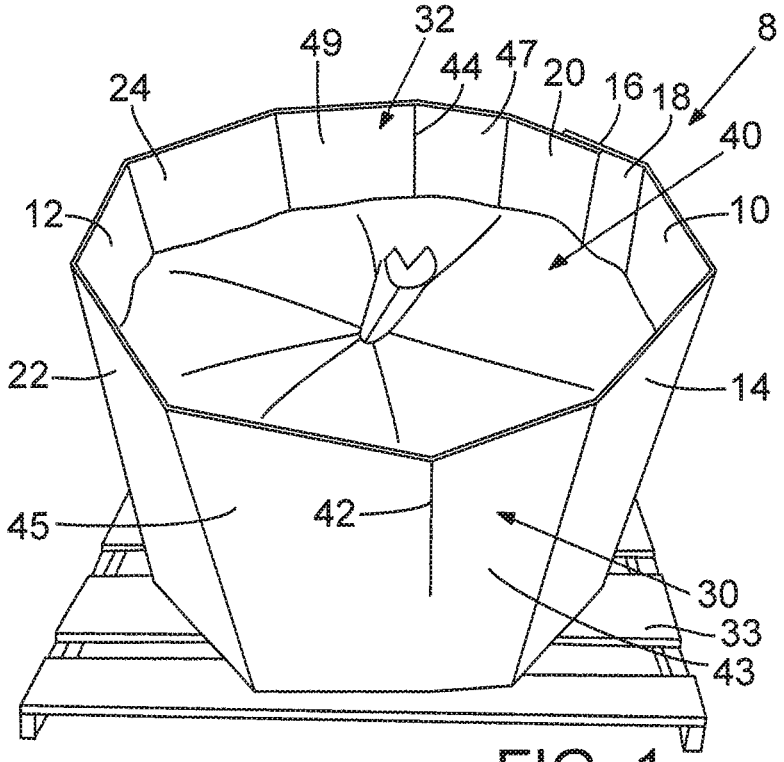
FIG. 1 (PRIOR ART)
FIG. 1 is a perspective view of a prior art corrugated paper board container for fillable material.
Figure 2:
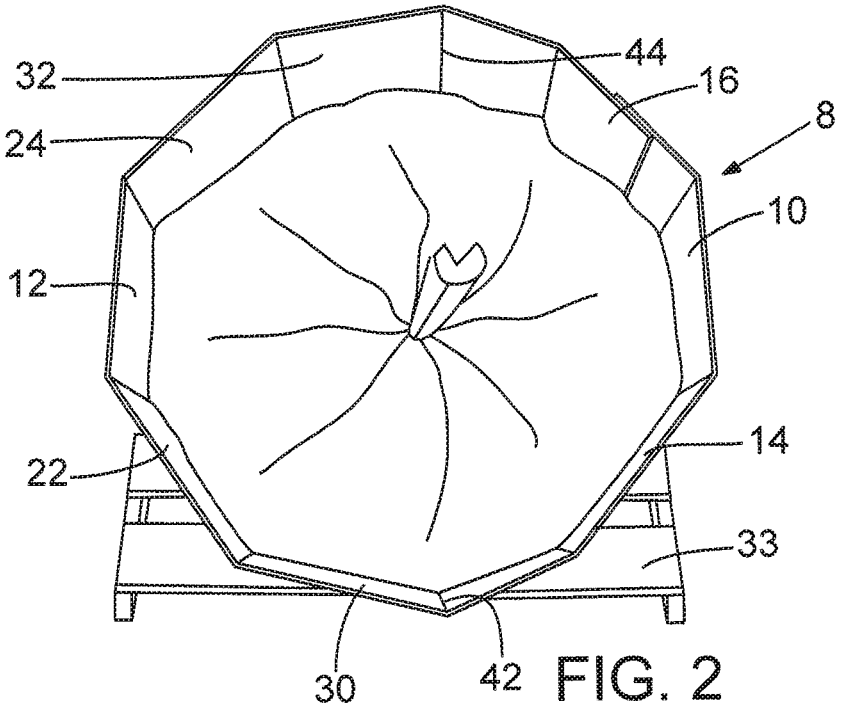
FIG. 2 (PRIOR ART)
FIG. 2 is a top plan view of the container of FIG. 1.

In accordance with an aspect of this disclosure, bulge control scores, also called bulge control lines, are provided in the largest width panels of a combo bin prior to any filling. These bulge control scores subdivide the side wall panels into a plurality of upright sub-panels that form as a container is filled and bulges out. The bulge control scores are formed by weakening the side walls of the container (typically the largest width side walls, width meaning the distance in a horizontal direction when the wall panels are in an upright orientation) along which bulging is to be controlled. In one example, this weakening can be provided by forming compression lines in a surface of a plurality of side wall panels of a corrugated paper board container, such as in the two widest opposed side wall panels or side walls, such as in the interior surface of the wall panels to be subjected to controlled bulging. The extent of compression used to form the bulge control lines can be varied. In one example, the paper board is compressed from the surface sufficiently to deform the fluted material of the paper board. The paper board compression will rebound following compression, but the bulge line formations to guide the bulging of the side wall remain effective.

As a specific example, the paper board can be compressed to a depth of 25 percent from the interior surface with rebounding following compressing resulting in a bulge line that is 5 percent of the depth or thickness of the paper board. An exemplary range of initial compression would be from 15 percent to 35 percent. As mentioned above, if a large combo bin filled with flowable material has no features to prevent it from doing so, the panel or panels of the greatest width will likely fracture or buckle near the middle, in response to hydraulic forces, to relieve stress. This singular fracture creates a spouting condition (the worst situation) resulting in subdividing the spouted side wall panel into two sub-panels that are generally equal in width.

As another aspect of this disclosure, bulge control lines are provided to intentionally form, at a minimum, a plurality of at least three upright sub-panels as the bin is filled and that desirably extend from the bottom to the top of the combo bin, and/or from a location adjacent to the bottom of the bin to the top of the bin. Desirably a sub-panel spans or extends in an upright direction across the center of the widest side wall panels of the combo bin. In a desirable example, one of these sub-panels is centered or centrally positioned on each of the largest (width) panels (e.g., the two widest opposed side wall panels) to thereby extend across the area of the side wall that is prone to spouting in the absence of controlled buckling. These subdivided panel sections can be referred to as sub-panels because, while they are defined by lines of weakness (scores or bulge lines), the bottom flap associated with each of the overall widest panels, or the bottom of the container in an embodiment with a bottom formed separately from an upright tube formed from the side walls, desirably restrain the bulge lines from operating when the container is in an unfilled state. It is the bulge of the combo bin upon filling that actually forces the bulge lines to operate and form the upright sub-panels. The combo bin can also be provided with spaced apart encircling reinforcing straps in addition to bulge control lines.

In an embodiment wherein one of the sub-panels is centrally located in the widest panel, there will be at least two other sub-panels (e.g., at least one on each side of the centrally located sub-panel). The widths of the sub-panels do not have to be equal but the central width of the central or mid sub-panel is desirably equal to or less than (at its narrowest point) than the width of any vertical non-sub-paneled side wall panels of the combo bin (such as less than the width of the end and corner wall panels in the case of an elongated octagonal combo bin). This assures that any further buckling outside of the defined bulge lines, unintended but naturally occurring, happens in those other non-widest panels, which are less critical.

Figure 3:
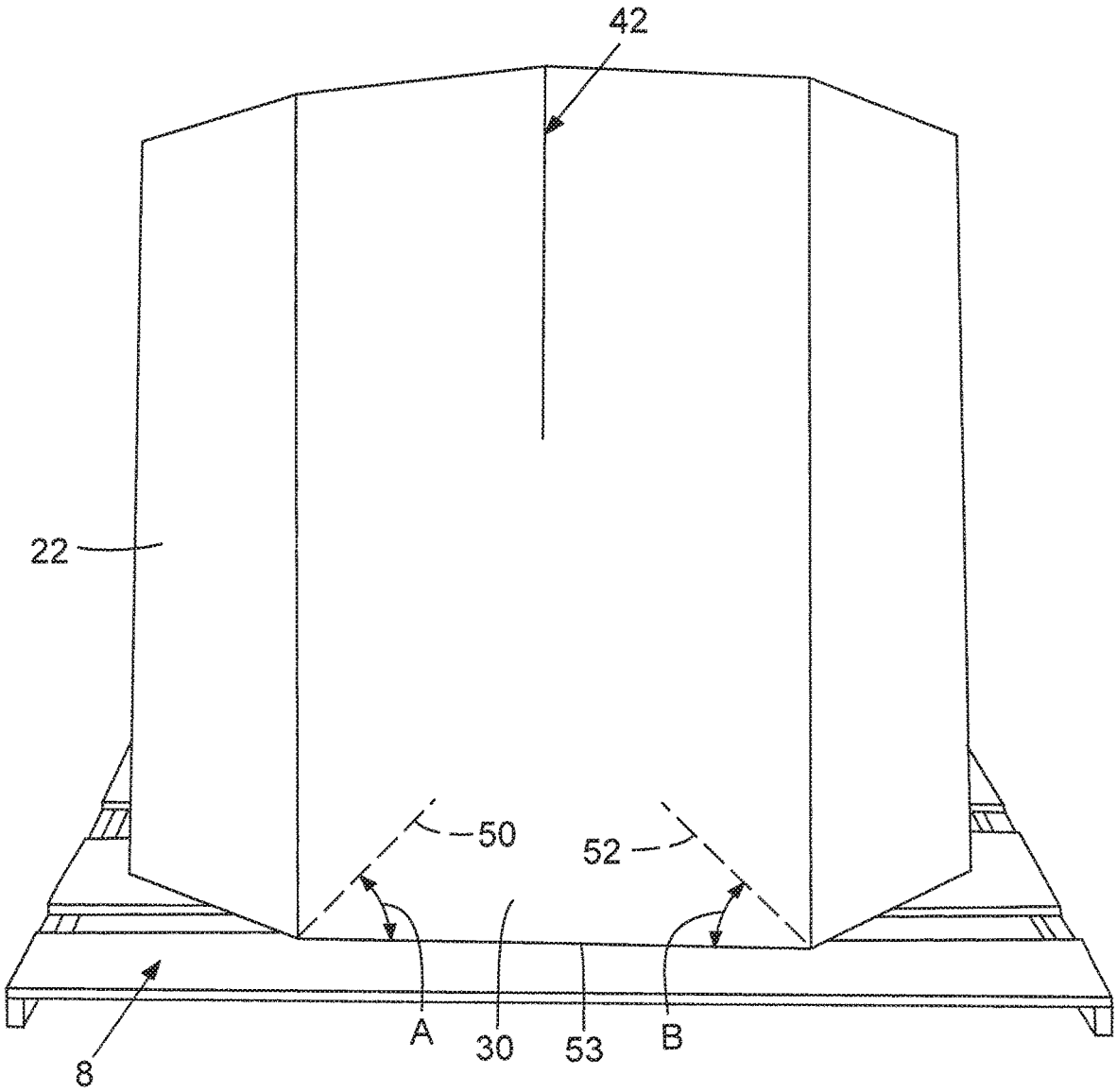
FIG. 3 (PRIOR ART)
FIG. 3 is a side elevation view of the container of FIG. 1.
Figure 4:
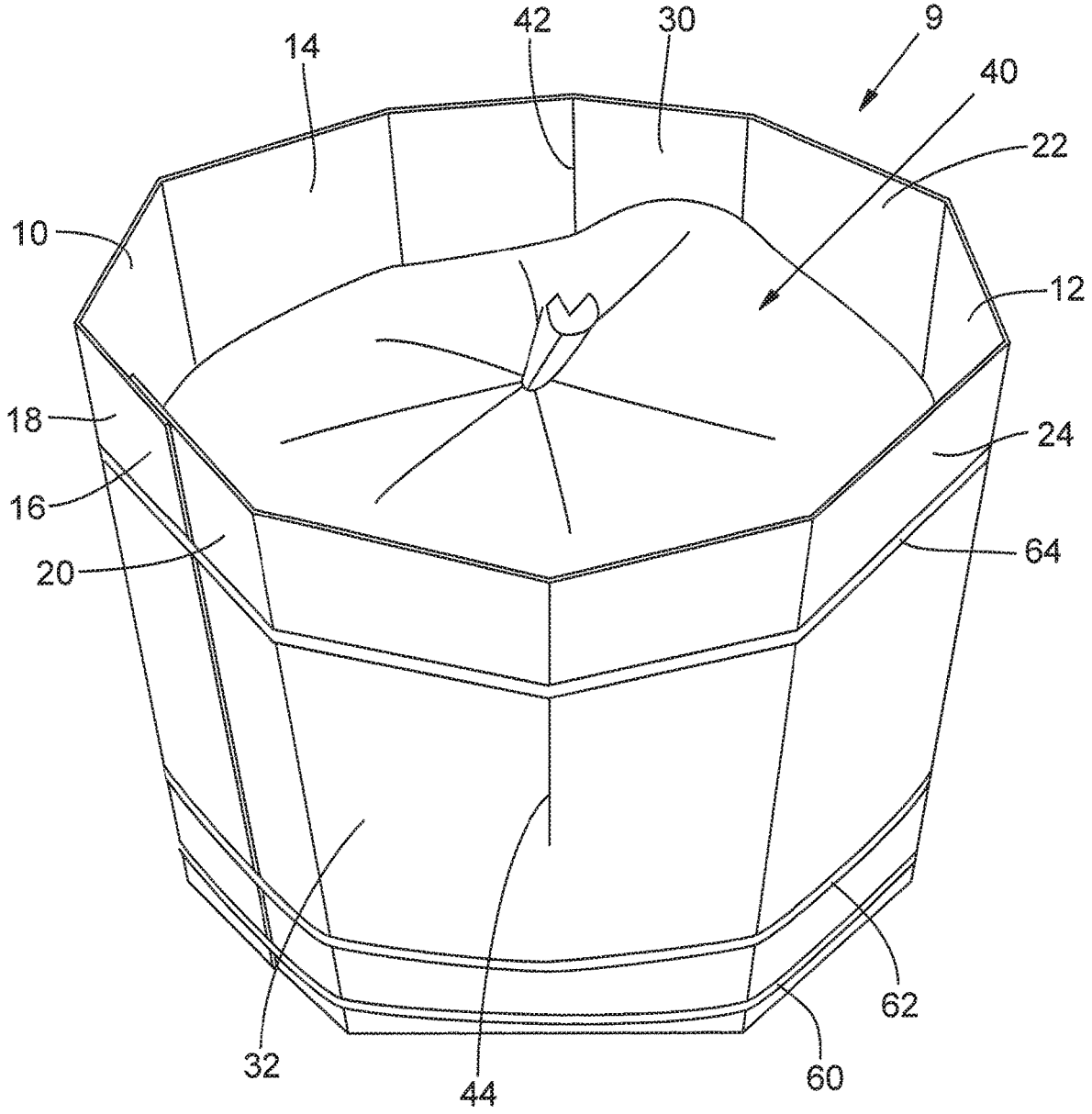
FIG. 4 (PRIOR ART)
FIG. 4 is modified form of container of FIG. 1 having surrounding straps along lower and upper portions of the container.

As another aspect of this disclosure, it is desirable to control the starting point of bulging that takes place along the bulge control scores. Encouraging the container to start bulging to create sub-panels in the intended path is highly desirable in order to obtain highly repeatable results. Because the bottom flaps of the container or a separately attached base or bottom normally preclude the operation or bending along these scores or bulge control lines, one can utilize a secondary mechanism to actuate the bulging. Containers traditionally bulge and fail with panel buckling radiating out of the corners of the bin in a 30-45 degree angle (see FIG. 3). By starting the predetermined bulge scores at or adjacent to the lower corners of the wall panels to be bulge controlled, and at the same or a similar angle, such as within plus or minus ten degrees of one another, the bulge will start to shape and form along the predetermined lines, and ultimately follow them throughout.

It is possible to start one or both of the lines away from the associated lowest corner (either upwardly above the corner, inwardly from the corner, or both). However, this does increase the possibility that the bulge controlled panel will break in an unintended area first. The most desirable embodiment is to start the bulge lines at the lower corners of the panel to be bulge controlled and to have the bulge lines extend upwardly to the upper edge of such bulge control panel. However, starting each bulge line adjacent to the nearest lower corner, such as within two to four inches of the lower corner, constitute additional embodiments. The bulge lines can also terminate short of the upper edge of the bulge controlled wall panel, such as adjacent to the upper edge, such as within two to four inches of the upper edge. Also, the score lines can terminate at locations at or spaced inwardly from the upper corners of the bulge controlled wall panel.

As yet another aspect of this disclosure, the shape of the bulge line pathways are controlled to result in a desired number of upright sub-panels. Again, in desirable embodiments, at least three sub-panels extend from the bottom to the top, and/or adjacent to the top of the bulge controlled side panels, when formed. As explained below, the bulge control pathways can take a number of shapes.

One particularly desirable set of bulge pathways is formed as follows and utilizes upwardly extending spaced apart curved bulge line pathways. These bulge pathways can be mirror images of one another and can converge moving upwardly from the respective lower corners of the bulge controlled side wall and can also diverge at a location above the horizontal center line of (and above the center of) the combo bin as they extend toward the upper edge of the side wall. A pair of bulge lines in an upright hour glass configuration is one specific example that results in three upright sub-panels. The narrowest distance or width between the pathways can vary.

As a specific desirable example, each such curved bulge line can start at a respective lower corner of the side wall and emanate out at a 30-45 degree angle and can arc in an upward manner. One third to one-half of the vertical distance up the side wall, the arc starts to sweep back. This arc and the associated generally-mirror-image of it creates the paths for the container to bulge as the container is filled with contents. The wall panels, including those with bulge lines, are desirably planar until the container is filled with contents and the bulge lines control the bulging of the container walls having the bulge lines. The bulge lines of weakness or scores create a "path" almost encouraging it to bulge in the lower middle section of the side wall, which results in additional bulge control. The curvature of the bulge lines in this specific example creates at least three interrelated and interfitting convex/concave sub-panels that give the sub-panels additional rigidity beyond the material bending stiffness alone. In addition the curvature naturally bends the upper most portion of the container back into itself, further reducing the overall width of the filled container. As mentioned before, in elongated containers this area typically splays outwardly creating the greatest external dimension (the largest challenge to material handling in racking systems). With the two opposing curving scores, an upright edge is defined between them, reducing the external width dimension between the opposing sub-panels with a defined structure; resulting in a mitigation of the spouting behavior of a combo bin that does not have the bulge control features.

The creation of a plurality of upright sub-panels in the largest width panel is an important aspect of this disclosure as it eliminates or mitigates the propensity of unintended panel buckling. Desirably, the sub-panels, when formed as a result of filling the container, extend from the bottom, or a location adjacent to the bottom, to the top of the bulge controlled widest side walls of the combo bin even if the bulge control lines do not extend from the bottom to the top of the side walls. This also enables the combo bin structure to form something closer to a rounded shape at the top; a shape that is closest to equilibrium given a uniform loading force from the contents inside the container. By starting the scores at or adjacent to the lower corner regions of the panel to be subdivided, additional assurance is gained that the scores (predetermined buckling lines) will be followed and the panel will bulge in the intended way. Adding controlled upwardly extending bulge paths, such as of convex/concave shape, allows the container to bulge in response to hydraulic forces, but doing so by giving the combo bin a predefined shape and rigidity. This greatly increases the likelihood that no further unintended panel breaks will happen in the widest width panels as well as minimizing the upper flaring or spouting of the container.

Figure 5:
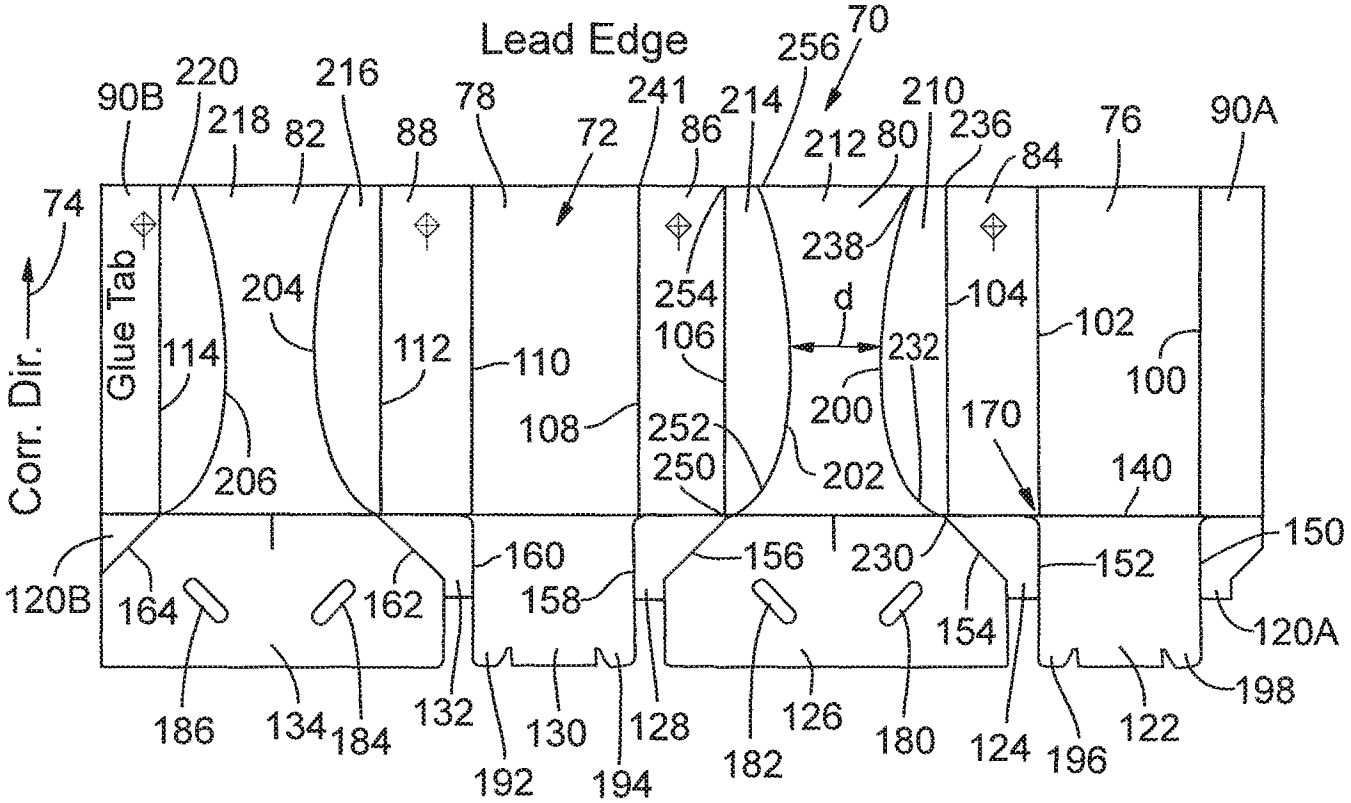
FIG. 5 is a top view of a first embodiment of a corrugate paper board blank that can be used for forming a first embodiment of a container in accordance with this disclosure, the container having bulge control lines in a plurality of the widest panels thereof.

FIG. 5 illustrates a corrugated paper board blank 70 for use in making an exemplary embodiment of a combo bin with bulge control lines or weakened areas in the widest panels of the blank. With reference to FIG. 5, a corrugated paper board blank comprises or consists of a body 72 of a plurality of layers comprising paper, including interior and exterior layers and a corrugated fluted core, forming the blank. The corrugated paper board blank can have additional layers. A corrugated paper board container is one formed from such a blank. The blank need not be in one unitary piece, although in form of FIG. 5 the container blank is an integrated one piece blank. In the form shown in FIGS. 17 and 18, a first integrated one piece blank is used to form the walls of the container of FIG. 16 and a separate integrated one piece blank is used to form the base portion of the container. The direction of the corrugations is desirably upright, vertically when the combo bin is erected, as indicated by arrow 74. The illustrated body is comprised of a plurality of side wall forming panels. The number of side wall panels can be varied. An octagon shaped combo bin is one desirable example. However, the bin typically is not of an equilateral octagon configuration, as it can have a pair of side walls that are wider than the other walls. End walls and corner forming walls can be of the same width or, as illustrated in the FIG. 5 embodiment, of different widths.

Figure 16:
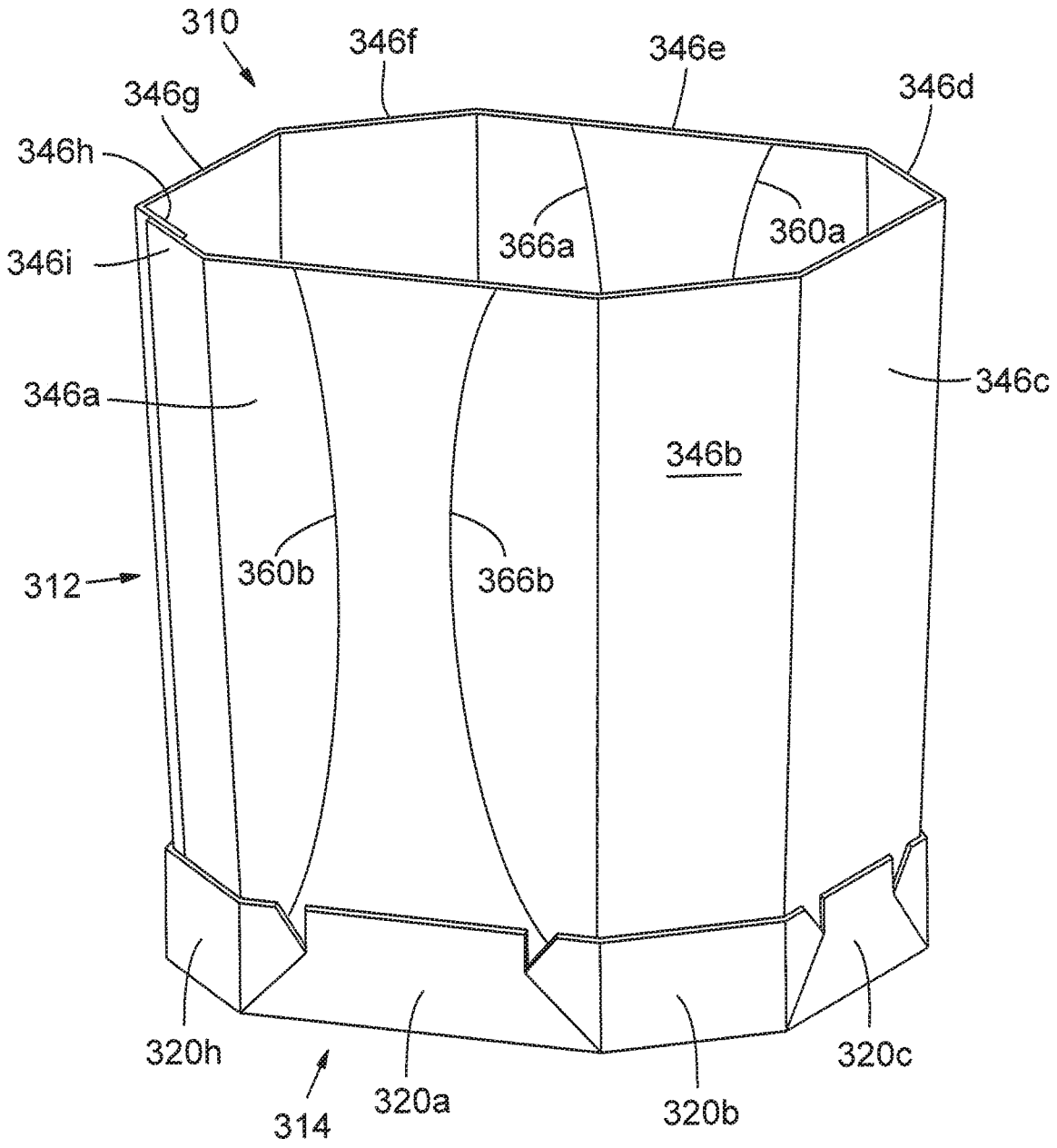
FIG. 16 illustrates a corrugated paper board container having bulge control lines in a plurality of its widest panels; and wherein the container is formed by a tubular structure comprising a plurality of side walls and a bottom forming portion that receives the tubular structure.
Figure 17:
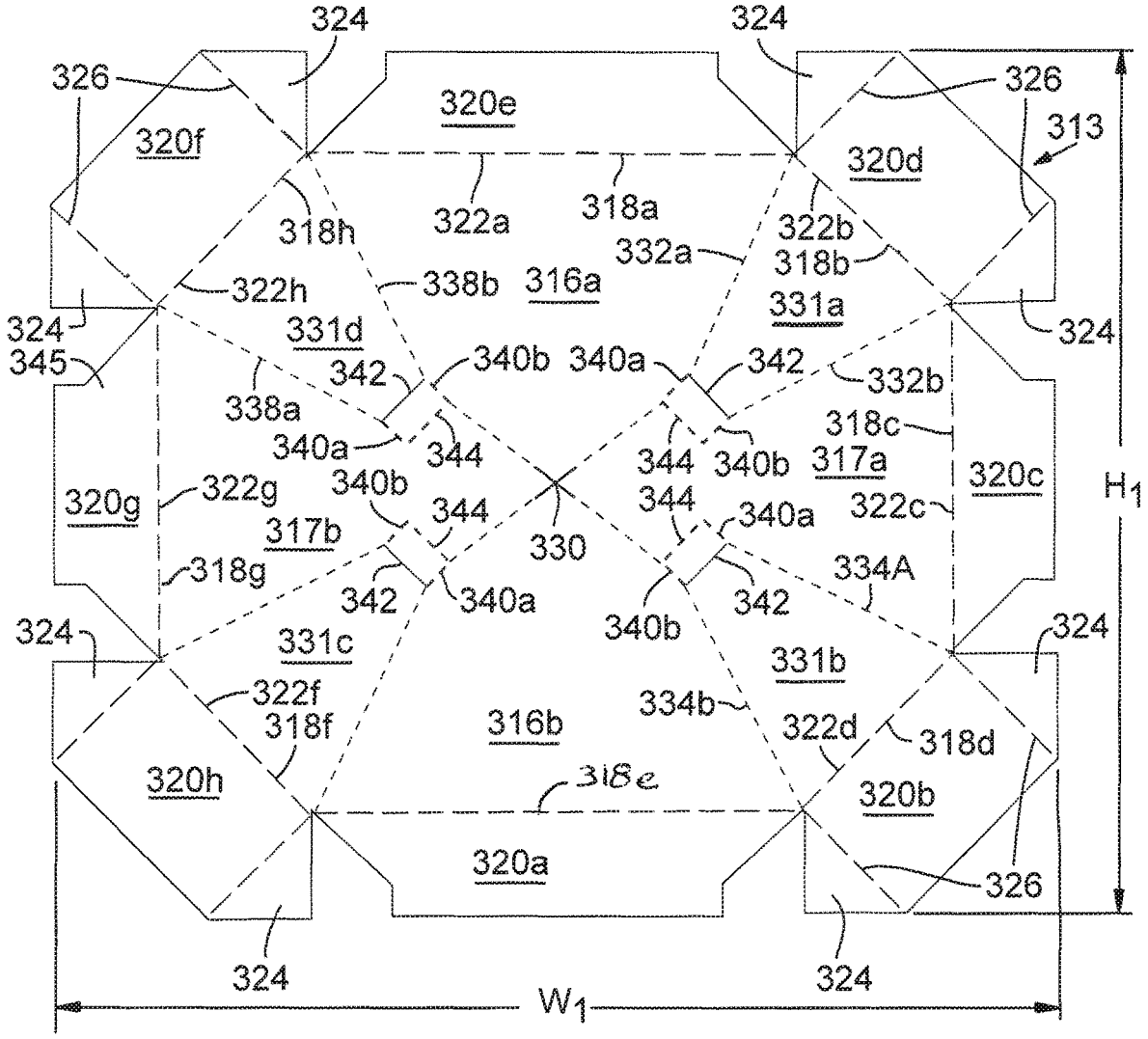
FIG. 17 is a plan view of a corrugated paper board blank that can be used to form the bottom portion of the container of FIG. 16.
Figure 18:
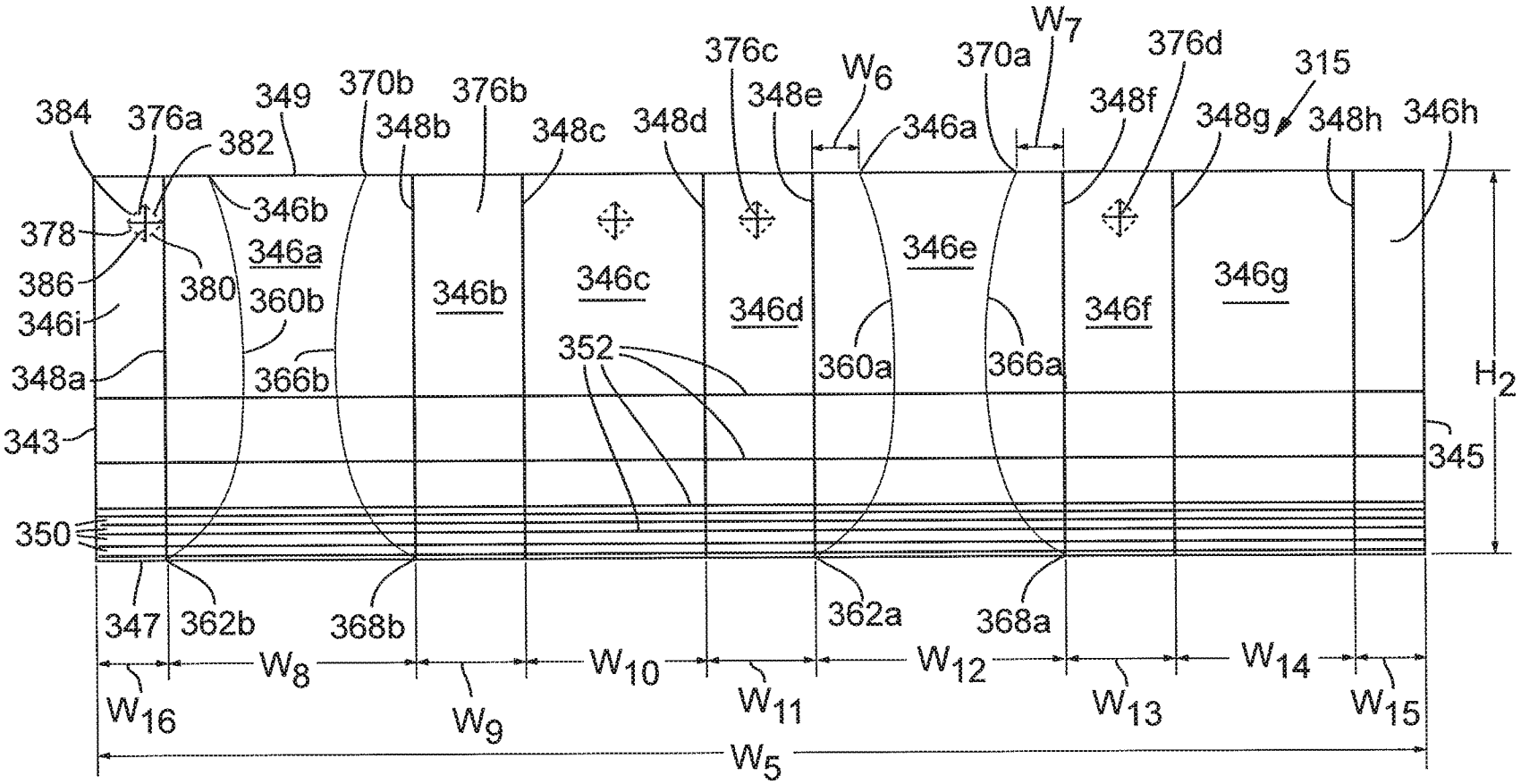
FIG. 18 is a plan view of a corrugated paper board blank that can be used to form the tubular portion of the container of FIG. 16; it being understood that the bulge control lines in the tubular portion can take any of the forms previously described in FIGS. 5 through 15, as well as forms described hereinafter that minimize or eliminate spouting.

More specifically, the body 72 of the embodiment in FIG. 5 has first and second end forming walls 76, 78 and side wall forming panels or walls 80, 82. The illustrated combo bin blank has a first corner panel 84 positioned between end wall panel 76 and side wall panel 80; a second corner panel 86 positioned between side wall panel 80 and end wall panel 72; a third corner panel 88 positioned between end wall panel 72 and side wall panel 82; and a fourth corner forming panel comprised of panel sections 90A and 90B. Panel sections 90A and 90B are glued together when the container is manufactured. Panel section 90A is positioned alongside end wall panel 76 and panel 90B is positioned alongside side wall panel 82. The side edges of the respective wall panels are joined together along respective fold lines 100, 102, 104, 106, 108, 110, 112, and 114. These fold lines are upright, such as vertical, when the combo bin is erected. A respective bottom forming panel is joined to each of the wall panels in this illustrated example of FIG. 5. In the embodiment of FIGS. 16-18, these bottom panels are eliminated and the bottom is formed by a separate bottom or base structure. The bottom panels are indicated at 120A, 122, 124, 126, 128, 130, 132, 134, and 120B. The respective bottom panels are joined to associated wall panels and are foldable about a fold line 140 that extends horizontally (in FIG. 5) from side to side of the blank 72. Thus, bottom panel section 120A is foldable about fold line 140 relative to panel section 90A; panel section 122 is foldable about the fold line relative to end wall panel section 76; bottom panel section 124 is foldable about the fold line 140 relative to corner wall panel 84; bottom panel section 126 is foldable about the fold line relative to side wall panel section 80; bottom panel section 128 is foldable about the fold line relative to corner wall panel 86; bottom panel section 130 is foldable about the fold line relative to end wall panel 78; bottom panel section 132 is foldable about the fold line relative to corner wall panel 88; bottom panel section 134 is foldable about the fold line relative to side wall panel 82; and bottom panel section 120B is foldable about the fold line 140 relative to corner wall panel 90B. Respective cuts 150, 152, 154, 156, 158, 160, 162, and 164 separate the respective adjacent bottom panels from one another. The cuts 150, 152, 158 and 160 can have a curved or angled cut at their upper ends, one of which is indicated at 170 to facilitate folding of the respective bottom panel sections. Portions of the bottom panels, such as portions of the bottom panels attached to respective corner panels, can be crushed or otherwise densified to strengthen the bottom. The respective bottom panels 126 and 130 include slots 180, 182, 184, and 186 that receive tabs of the end wall panels (e.g., tabs 192, 194, 196, and 198) when the combo bin is assembled. The respective tabs are separated from adjoining portions of the bottom panels 122, 130 by V-shaped notches with side edges that, in this example, diverge at the same angle from one another. The bottom panels may be modified and interconnected using different interconnecting structures, adhesive or fasteners.

In the above example, the side wall panels 80 and 82 are the widest panels in the resulting combo bin structure. Although the corner panels and end wall panels can be of the same width, making the structure an equilateral octagon, in this example the corner panels are of narrower width than the end wall panels. For example, the corner panels can end up being 15 inches wide, the end wall panels 17 inches wide, and the side wall panels being 25¾ inches wide. These dimensions can be varied.

In FIG. 5, each of the widest panels, namely opposed side wall panels 80, 82, are provided with bulge formation lines on their interior surfaces. Bulge control lines as describe herein can be included in one or more other wall panels in addition to the side wall panels 80, 82. The wall panels with the bulge control lines comprise a panel body with first and second side edges, a bottom edge and a top edge. The panel body has a center and a horizontal centerline (when the wall panel is upright) that passes through the center of the wall panel body. In addition, the panel body has a vertical centerline passing through the center of the panel body. The wall panels with bulge control lines desirably have a plurality of bulge control lines, such as first and second bulge control lines, that desirably extend from a first location at or adjacent to the bottom edge of the panel body to a second location at or adjacent to the top edge of the panel body, the bulge control lines subdivide the panel body into at least three subpanels. The bulge control lines are desirably spaced at the first location at or adjacent to the bottom edge than at a third location that is above the first location. As alternative aspects of this embodiment, the third location is between the first location and the second location and can be about at a horizontal center line of the panel body; the third location comprises a region of a subpanel body, desirably the middle subpanel body if there are three subpanels, that extends from below to above the center of each panel body and/or from below to above the horizontal centerline of the panel body; the subpanels comprise a subpanel with portions positioned on opposite sides of the vertical centerline of the panel; the first and second bulge control lines are spaced from the vertical centerline of the panel body; the first and second bulge control lines are about equally spaced from the vertical centerline of the panel body; and/or the first and second bulge control lines are symmetric about the vertical center line of the panel body.

In FIG. 5, panel 80 is provided with two such bulge formation lines 200, 202. In addition, panel 82 is provided with two such bulge formation lines 204 and 206. Bulge formation lines subdivide side wall panel 80 into the respective sub-panels 210, 212 and 214. In addition, bulge formation lines 204, 206 subdivide side wall panel 82 into respective sub-panels 216, 218, and 220. When the box is empty, the sub-panels 210, 212 and 214 do not bulge out from one another in the illustrated embodiment but instead are planar. Similarly, when the container is empty, the sub-panels 216, 218 and 220 are also planar in this example.

Although they can be different, in FIG. 5, the bulge control lines of each of the side wall panels 80, 82 are the same. For this reason, only the bulge control lines of side wall panel 80 will be described. Bulge control line 200 starts at a location 230 at the lower right hand corner of the side wall panel 80 in FIG. 5. The control line 200 extends upwardly along a first path portion 232 that is angled at an angle typically from 30 to 45 degrees from the fold line 140. At a location that can be 20-30 percent of the way up toward the top edge 241 of the blank, the bulge line 232 curves upwardly to a greater extent from the starting angle and continues to extend upwardly. At a location above the horizontal center line of the side wall panel, the curve 200 bends to extend in a direction toward the upper right hand corner 236 of the side wall panel 80. The bulge control line 200 in this example terminates at a location 238 along the upper edge 241 of the side wall 80. The location 238 is spaced inwardly from the corner 236. In this example, bulge control line 202 is the mirror image of bulge control line 200, although it can have a different shape. The bulge control line 202 in FIG. 5 starts at the lower left hand corner 250 of side wall panel 80, extends upwardly along a first portion of a path 252, at the same angle in this example as the path 232, and then bends backwardly toward the upper left hand corner of the side wall panel 254 after reaching a location above the horizontal center line of the container. The fold line 202 terminates at a location 256 spaced inwardly from the corner 254. The distance d between the fold lines 200, 202 at their narrowest location is, in this example, less than or equal to the width of the corner panels 76, 78. Consequently, once the sub-panels 210, 212 and 214 are formed by bulging of the side wall 80 in response to hydraulic forces of contents of the erected bin, the side wall 80, along with side wall 82, will bulge outwardly as guided by the respective sets of bulge lines 200, 202 and 204, 206; without unintended buckling. If further stresses are encountered, the end panels 76, 78 will tend to buckle before there is further buckling of the side wall panel because the narrowest width of the sub-panel 212 is narrower than the width of the end panels 76, 78.

Figure 6:
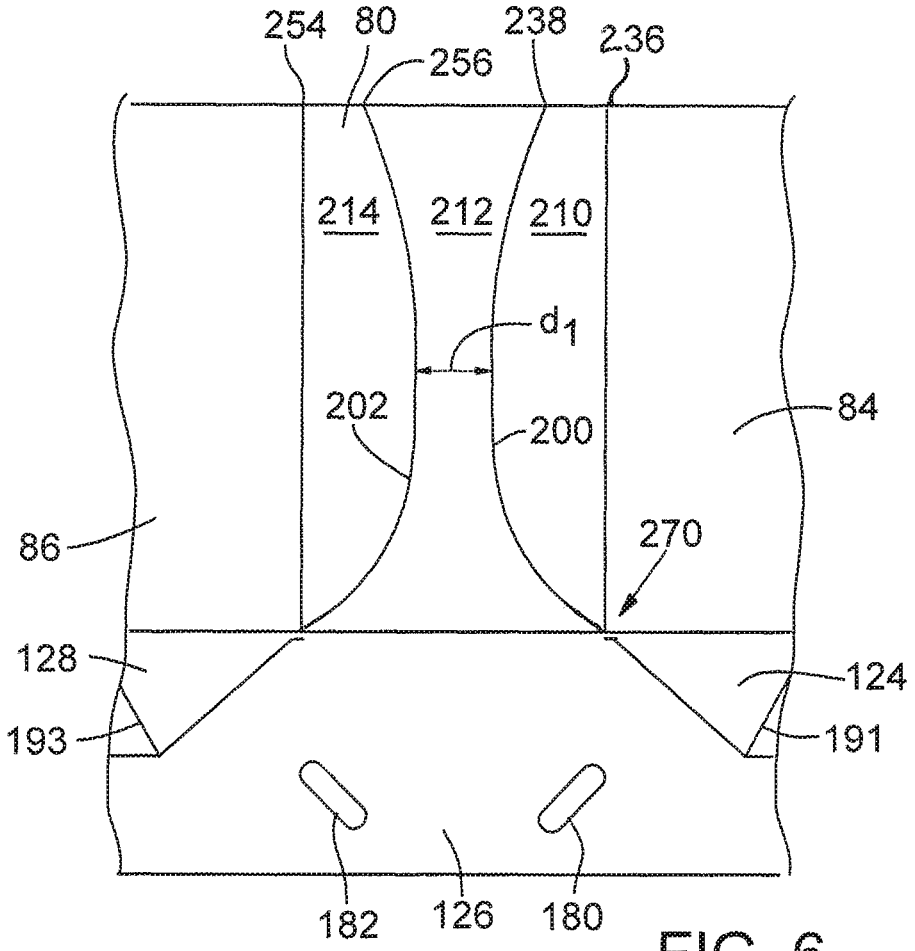
FIG. 6 is a side elevational view of a side wall panel of a corrugated paper board container with bulge control lines in a modified configuration from those shown in FIG. 5.

FIG. 6 illustrates an alternative form of side wall panel structure in which the distance dl is narrower than the distance d in the FIG. 5 embodiment. In the FIG. 6 embodiment, the side wall 80 is shown. In addition, corresponding components are given the same numbers in FIG. 6 as in FIG. 5 for convenience and will not be discussed further. The same numbers for corresponding components have been used in the FIGS. 7-15 embodiments. In the FIG. 6 example, a perforation 191 and a perforation 193 can be provided in a portion of the bottom panels 124, 128 for folding purposes. Portions of the corner panels 124, 128 can be densified, but typically none of the bottom panels connected to the end walls are densified.

Figure 7:
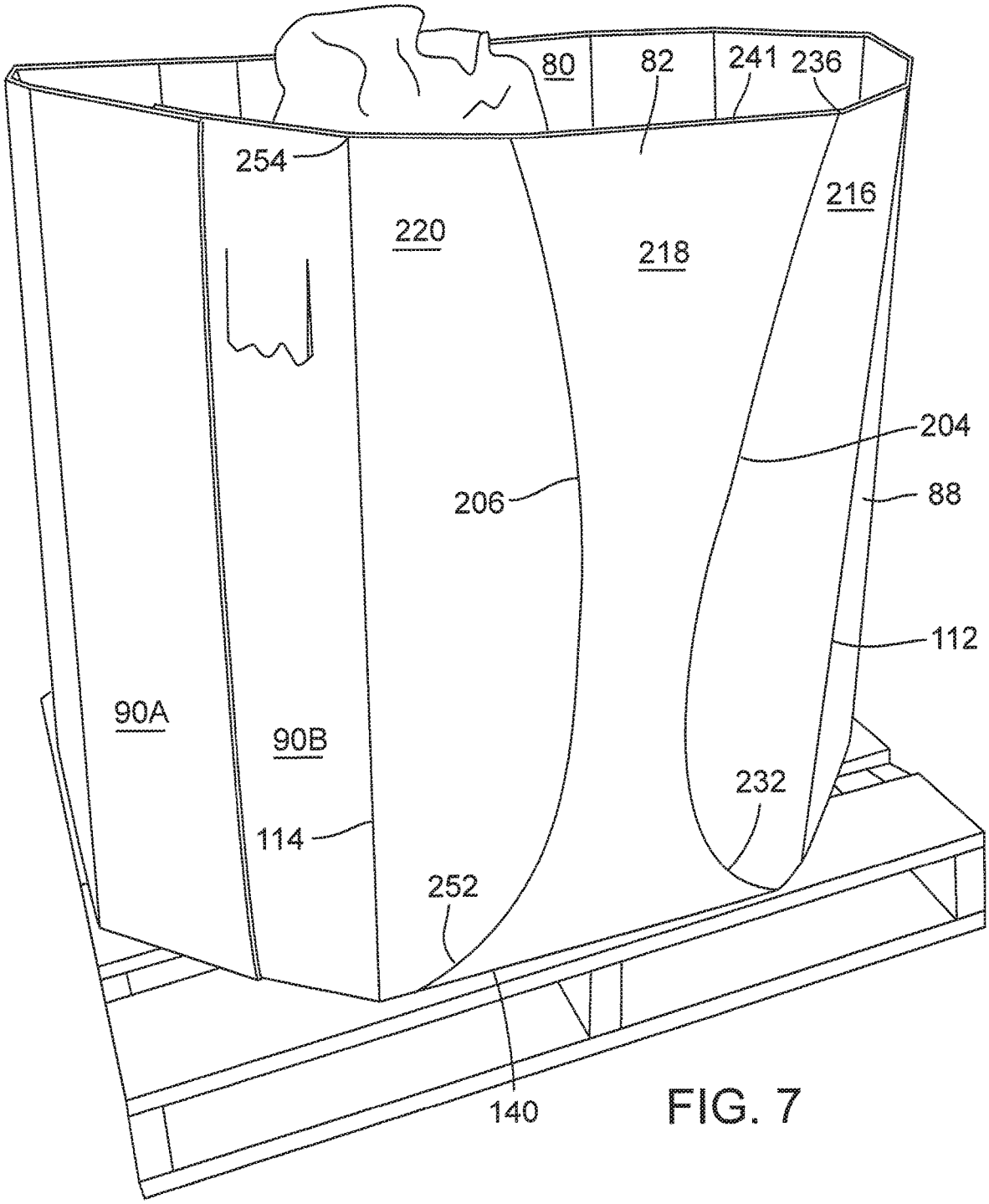
FIG. 7 is a perspective view of a container formed from the blank of FIG. 5.

FIG. 7 illustrates a combo bin formed from a blank like that shown in FIG. 5 at two-thirds scale. In FIG. 7, the panel 82 is shown in a forward most position in this figure. As one can see, the bulge lines 204, 206 caused the container side wall 82 to subdivide into three upright sub-panels 216, 218 and 220. The bend or bulge lines 204, 206 are indicated generally in this figure. The actual bulge of the boxes may not precisely follow the bulge lines but tend to be close to the location of the bulge lines. As the bulging sub-panels are formed and bulging approaches the upper edge 241 of the container, the bulging may deviate from the bulge line and head vertically upwardly up from some point. As is apparent, in this example, a relatively flat center sub-panel 218 is formed rather than an outwardly projecting angular spout located roughly in the center of panel 82. Consequently, the overall width of the combo bin between the side panels 80 and 82 is reduced.

FIGS. 8 through 15 illustrate examples of side walls or side wall panels with alternative constructions of bulge control lines. These bulge control lines are desirably included in a plurality of the side wall panels of a container. Most desirably, the bulge control lines of these FIGS. are included in side wall panels of the greatest width, such as in the two opposed side wall panels of an octagon container having two side wall panels of the greatest width and other side wall panels (e.g., end wall panels and corner wall panels of a smaller width. In these FIGS., the widest side wall panel 80 is indicated along with the adjacent corner panels 84 and 86. The bottom panel section 126, if included, is also indicated. Side wall 82 can have bulge lines like those shown for side wall 80. The remaining portions of the combo bin blank can be as previously described. Again, different bulge lines can be used in different panels. Otherwise, the focus of the description below is on the respective bulge forming lines in the side wall 80.

Figure 8:
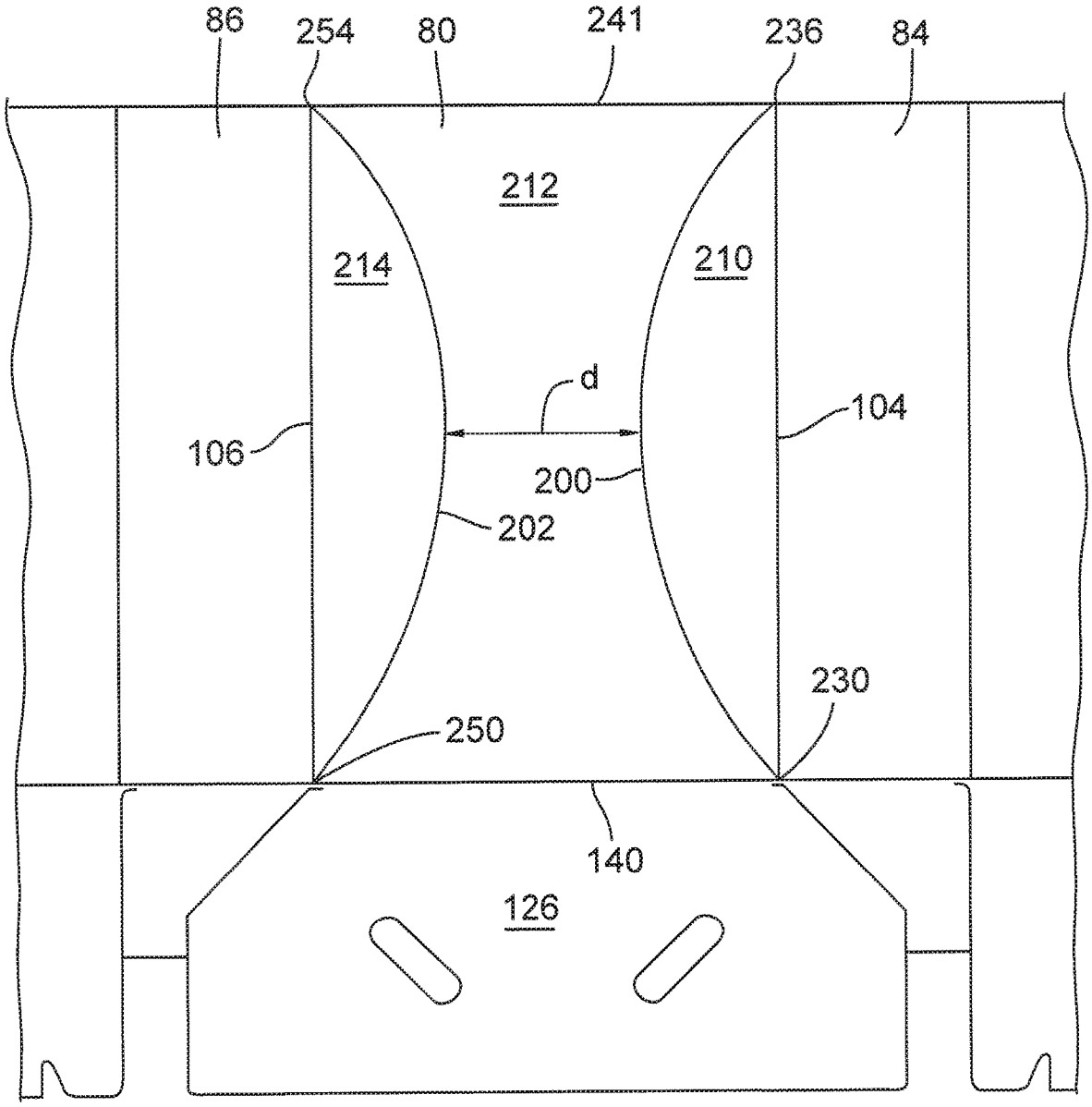
FIG. 8 is a side elevational view of a side wall panel of a corrugated paper board container with another alternative form of bulge control lines.

In FIG. 8, the bulge line 200 is curved, much like the bulge line 200 shown in FIG. 5. However, the bulge line 200 of FIG. 8 terminates at its upper end at the upper right hand corner 236 of the panel 80. In addition, the bulge line 202 of FIG. 8 terminates at the upper left hand corner 254 of the panel 80. In the FIG. 8 example, the closest distance d between the arcuate bulge lines 200, 202 is greater than the distance d in FIG. 5. The center portion of the sub-panel 212 spans the center of the side wall panel 80 where the panel would tend to buckle in the absence of the bulge lines. As a result, bulging is shifted outwardly from the center of this panel toward the bulge lines. It should be noted that the respective bulge lines on opposite sides of the center of the side wall 80 need not be mirror images of one another as they can be of a different configuration.

Figure 9:
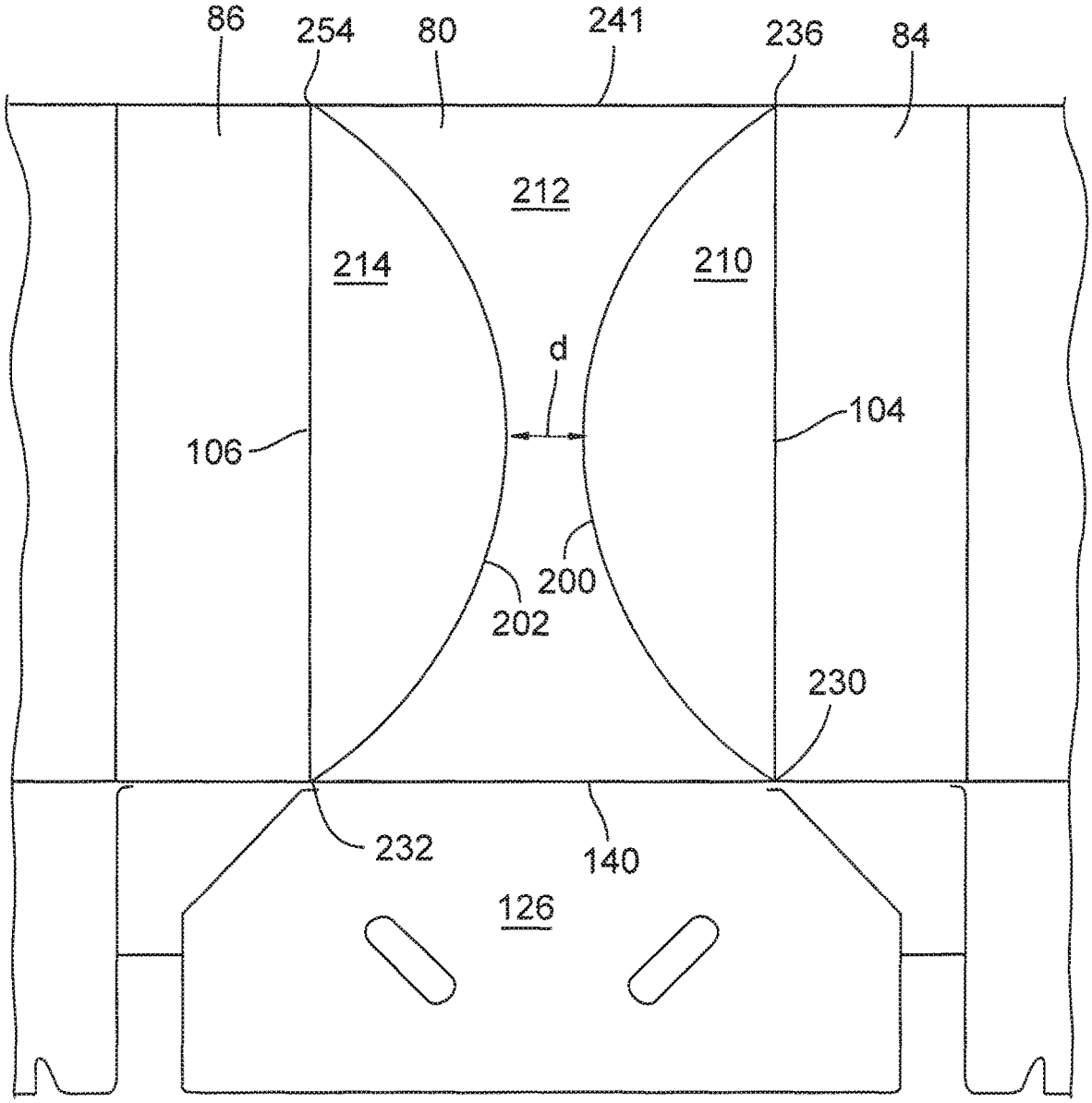
FIG. 9 shows an embodiment of a side wall panel of a corrugated paper board container with a further alternative form of bulge control lines.

In the embodiment of FIG. 9, the respective bulge lines are such that the distance d is narrower than the distance d in FIG. 7. Again, the respective bulge lines 200, 202 in FIG. 8, like those of FIG. 7, terminate at the upper right hand corner 236 of side wall 80 in the case of bulge line 200, and at the upper left hand corner 254 of side wall panel 80 in the case of bulge line 202. The bulge lines 200, 202 in FIG. 8 can be mirror images of one another or they can be different from one another.

Figure 10:
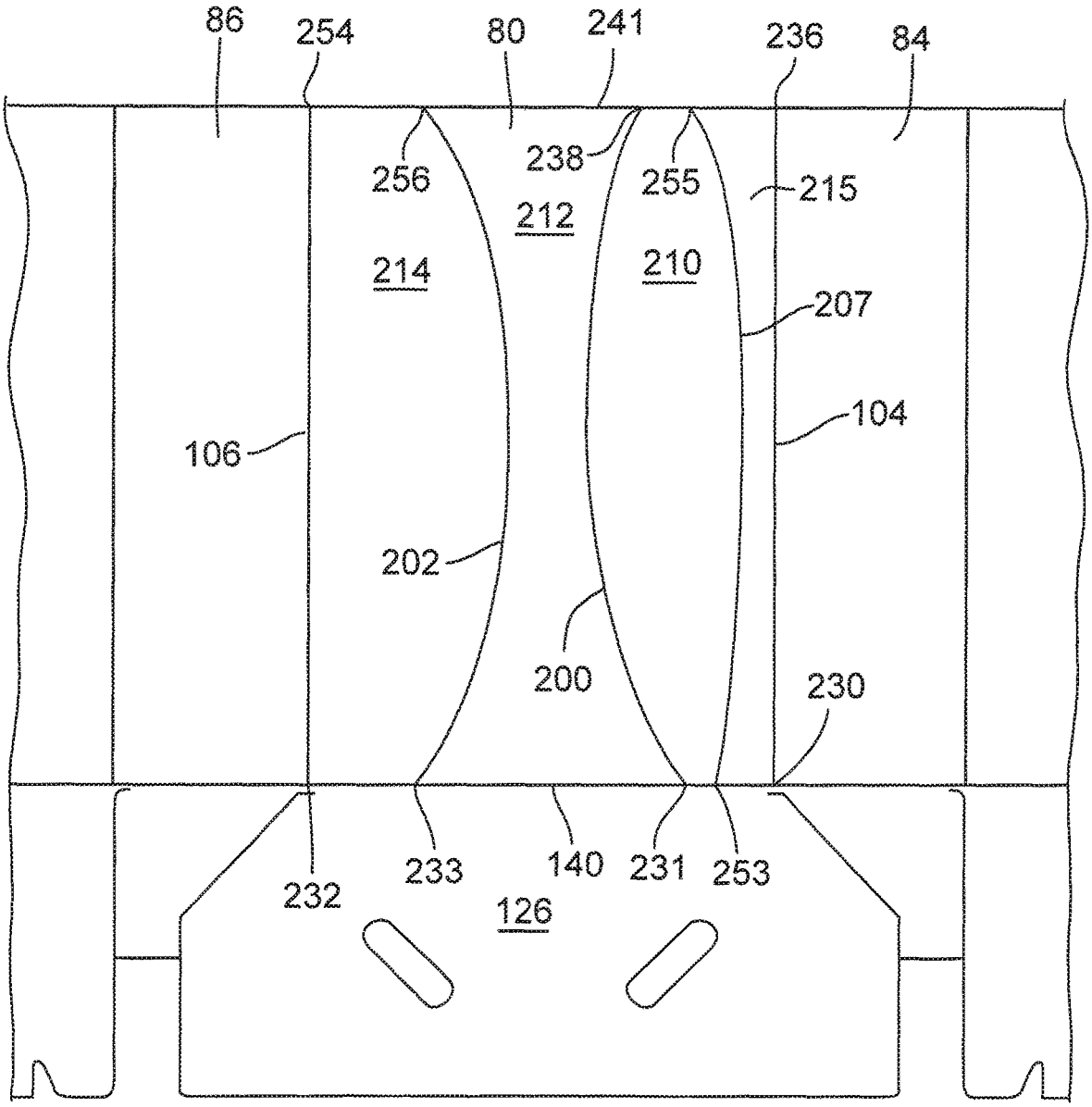
FIG. 10 illustrates an embodiment of a side wall panel of a corrugated paper board container with yet another form of bulge control lines.

In FIG. 10, an example is illustrated in which there more than three upright sub-panels are formed by bulge lines in side wall 80 when the container is filled. That is, in FIG. 9, bulge lines 200, 202 are provided along with an additional bulge line 207. Bulge line 207, in this example, curves in an opposite direction to the bulge line 200 and is positioned between bulge line 200 and fold line 104. As a result, an additional sub-panel 215 is provided in side wall 80 when the container is filled, in addition to sub-panels 210, 212 and 214. In the FIG. 9 example, bulge line 200 starts at a location 231, spaced inwardly from the lower right hand corner 230 of side wall 80. In addition, bulge line 202 starts at a location 233 spaced inwardly from the lower left hand corner 232 of the side wall 80. When the container is filled, the lower portion of the container tends to collapse or bulge with the bulge traveling from the corners toward the respective bulge lines 200, 202 at which point the buckling is guided to follow the bulge lines 200, 202 to define the sub-panels. In addition, the bulge line 207 provides yet another bulge line for the container to bulge along as the container is filled. The bulge line 207, in this example, starts at a location 253 spaced inwardly from the right hand corner 230 of side wall 80 and terminates at a location 255 spaced inwardly from the upper right hand corner 236 of the side wall 80. Another bulge line like bulge line 207 can be added between the bulge line 202 and the fold line 106. Bulge lines 200 and 202 are spaced from the center of the side wall 80 where the side wall would tend to buckle if no bulge lines were present.

Figure 11:
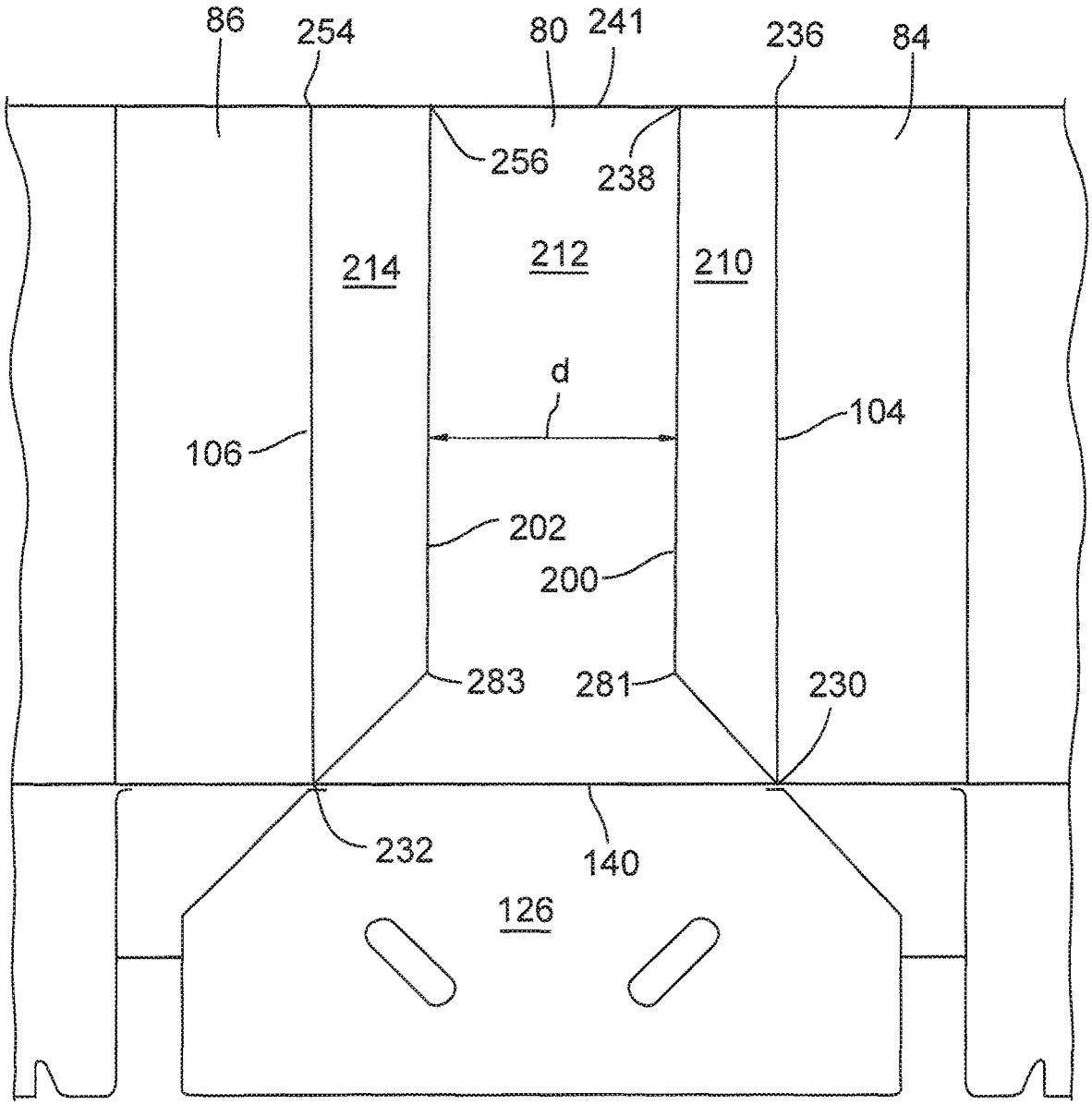
FIG. 11 illustrates a side wall panel of a corrugated paper board container with a still further form of bulge control lines.

FIG. 11 illustrates an embodiment with bulge lines 200, 202 that are not of a curved construction. In FIG. 11, bulge line 200 starts at the lower right hand corner 230 of side wall 80 and extends upwardly at an angle slightly greater than 45 degrees. In addition, bulge line 202 starts at the lower left hand corner 232 of the side wall 80 and extends upwardly at a similar angle to the initial portion of bulge line 200. Although schematically shown as being different from one another, desirably the lower portions of the respective bulge lines extend upwardly and inwardly at the same angle and the bulge lines are mirror images of one another. At location 281, which is typically 10 to 20 percent above the fold line 140, the bulge line 200 extends vertically upwardly to terminate at a location 238 along the upper edge 241 of the side wall 80. Similarly, bulge line 202 angles upwardly to a location 283 and then extends vertically upwardly to a location 256 along upper edge 241. The construction of FIG. 11 can mitigate the formation of spouts because the center panel 212 of the sub-panels 210, 212 and 214 spans the center of the side wall where a spout would tend to form, thereby encouraging bulging at locations spaced from this center. However, the vertical components of the bulge lines 200, 202 do not provide the additional structure achieved by curved bulge lines 200, 202 in the form previously discussed.

Figure 12:
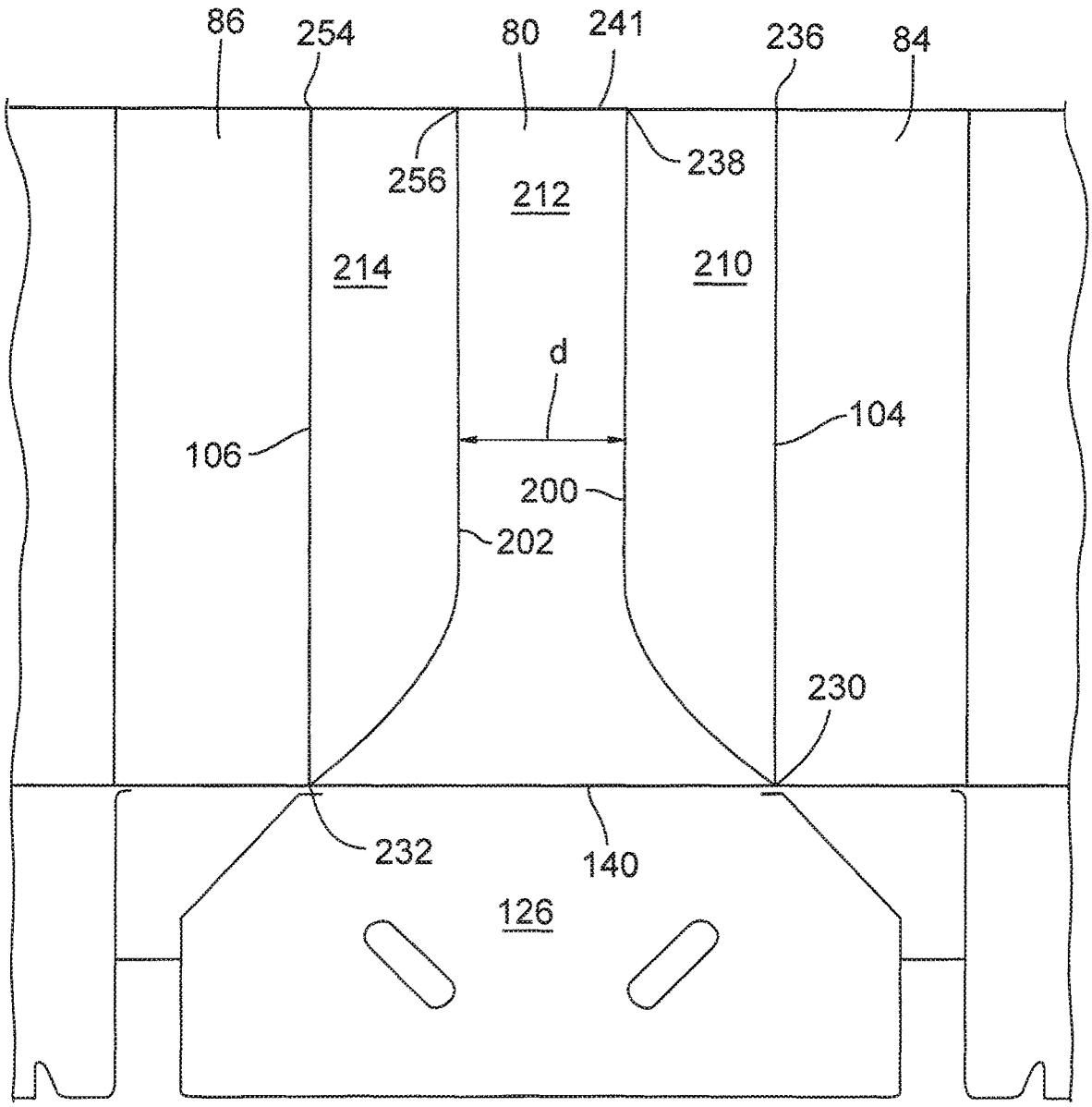
FIG. 12 illustrates a side wall panel of a corrugated paper board container having another form of bulge control lines.

The embodiment of FIG. 12 is like the embodiment of FIG. 11 except that the bulge lines 200, 202 are curved at their lower ends instead of the inclined angular construction of the bulge lines 200 and 202 of FIG. 11.

Figure 13:
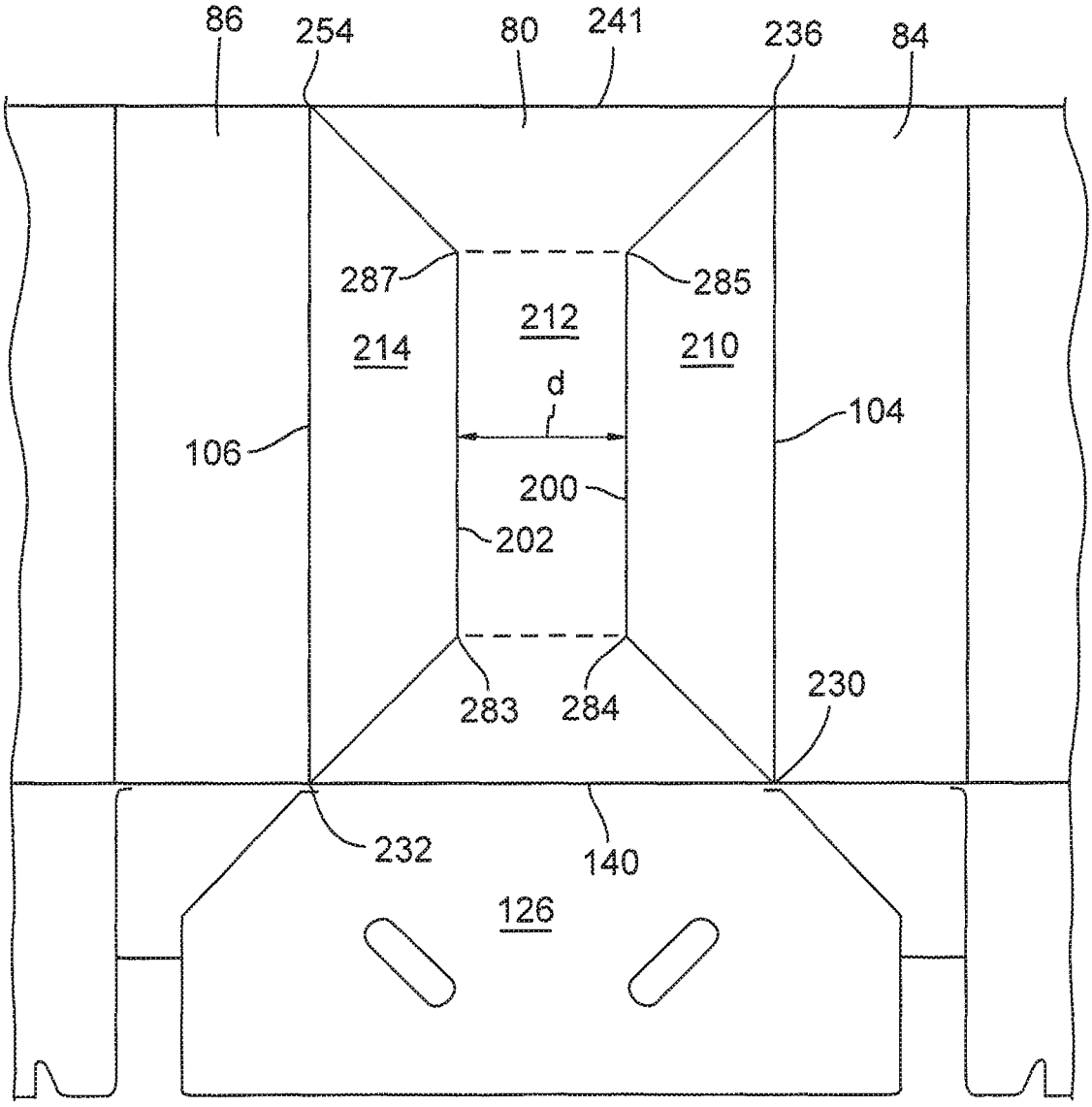
FIG. 13 illustrates a side wall panel of a corrugated paper board container with a further form of bulge control lines.

In the embodiment of FIG. 13, the bulge line 200 at the lower end is like the bulge line 200 of FIG. 10 and the bulge 202 at its lower end is like the bulge line 202 of FIG. 10. After reaching respective locations 281, 283 the bulge lines 202 and 204 extend vertically upwardly (when the bin is erected) to respective locations 285, 287. At location 285, bulge line 200 angles to the upper right hand corner 236 of the side wall panel 80. In addition, at a location 287, the bulge line 202 angles upwardly to the upper left hand corner 254 of the side wall panel 80.

Figure 14:
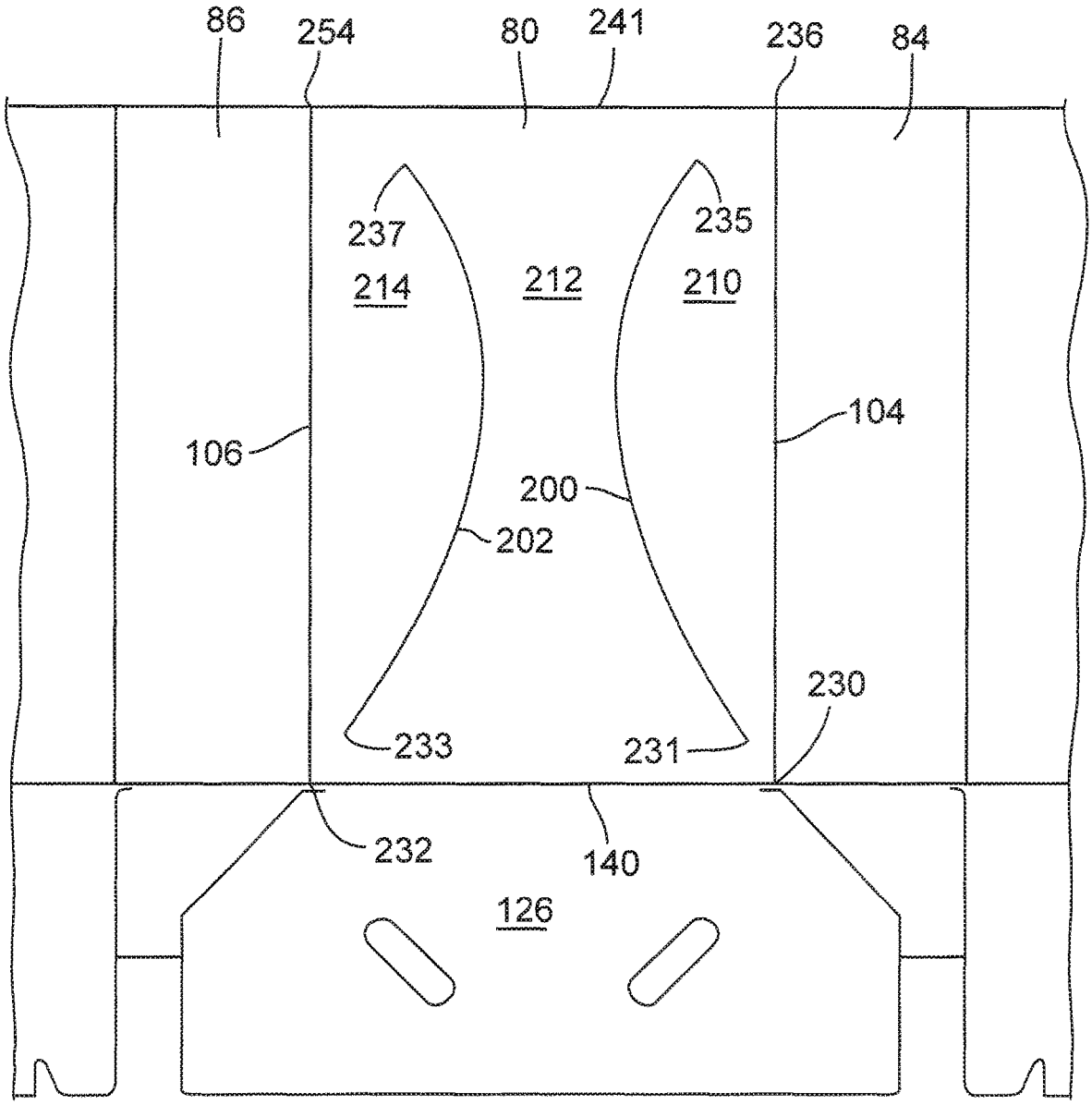
FIG. 14 illustrates a side wall panel of a corrugated paper board container another form of bulge control lines.

FIG. 14 illustrates an example where the respective bulge lines 200, 202 start and end at locations spaced from the respective corners of the side wall panel 80. Thus, in this embodiment, the bulge line 200 starts at a location 231 spaced inwardly and upwardly from the lower right hand corner 230 of the side wall 80 and terminates at a location 235 spaced inwardly and below the upper right hand corner 236 of the side wall panel 80. Similarly, the bulge line 202 starts at a location 233 spaced upwardly and inwardly from the lower left hand corner 232 of the side wall 80 and terminates at a location 237 spaced inwardly and below the upper left hand corner 254 of the side wall 80. When the bin of FIG. 14 is loaded, respective sub-panels 210, 212 and 214 would be formed rather than a centrally located spout.

Figure 15:
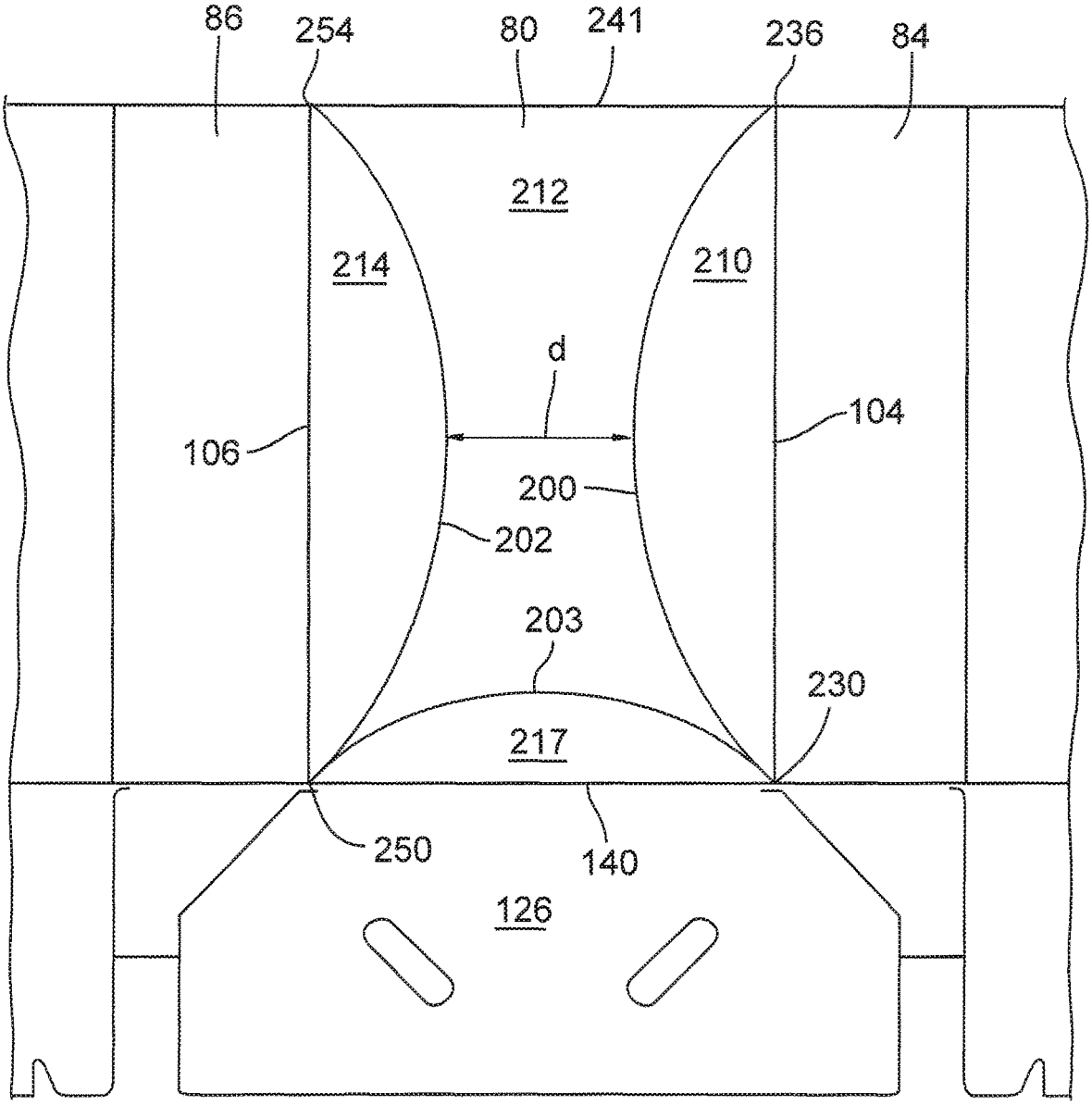
FIG. 15 illustrates a side wall panel of a corrugated paper board container with a still further form of bulge control lines.

FIG. 15 illustrates an example that includes a lower transverse bulge line 203 of an arcuate shape extending across side wall 80 from corner 230 to corner 250. In this example, a sub-panel 47 is also formed in side wall 80 as the container is filled. In addition, the sub-panel 212 is separated from the bottom of the container (fold line 140) by the sub-panel 217. In this example, three upright sub-panels 210, 212 and 214 are formed with the center sub-panel 212 spanning the center of the side wall 80. Each of these upright sub-panels extend from a location below the horizontal center line of the combo bin to a location above this horizontal center line.

The examples of FIGS. 8 through 15 are for purposes of illustration as not all of them have been tested and only some of them have even been tested in less than full scale tests.

Turning now to FIG. 16, a container assembly 310 according to another embodiment is shown. The container assembly 310 is also adapted to hold contents, such as flowable contents, being transported from a first location to a second location. The container assembly 310 has a tube portion 312 and a base portion 314. The tube portion 312 and the base portion 314 may be made of or comprise corrugated paper board. The tube portion 312 has bulge control score lines such as described below. The tube portion comprises side walls of the container and can have bulge control score lines of the side walls of any of the above described container side walls. One specific exemplary form of tube 312 with score lines is described below.

In the illustrated embodiment of FIG. 16 the tube portion 312 and the base portion 314 each have an octagonal shape (i.e., eight sides). It is contemplated, however, that the tube portion 312 and the base portion 314 can have any suitable shape such as rectangular, square, hexagonal, other polygonal shapes. It is also contemplated that the width W of the side walls can vary, such as set forth above for the side walls (e.g., side wall panels, corner panels and end wall panels) of the in the described containers.

Turning now to FIGS. 17 and 18, plan views of a base blank 313 and a tube blank 315, respectively, for the formation of the container assembly 310 of FIG. 16 are shown.

Referring first to FIG. 17, a top side 345 of the base blank 313 is shown according to one embodiment. The base blank 313 includes a bottom panel 316 having a generally octagonal shape (e.g., eight sides 318*a-h*). The eight sides 318*a-h* include first and second side wall sides 318*a*, 318*e*, end wall sides 318*c*, 318*g*, and corner wall sides 318*b*, 318*d*, 318*f*, and 318*h*. The bottom panel 316 includes eight side wall flaps 320*a-h* extending from and integrated with each of the eight sides 318*a-h*. These flaps include side wall forming flaps 320*a*, 320*e*; end wall forming flaps 320*c*, 320*g*; and corner wall forming flaps 320*b*, 320*d*, 320*f* and 320*h*. The corner wall forming flaps 320*a-h* are separated from the bottom panel 316 by respective fold lines 322*a-h*. The flaps 320*b*, 320*d*, 320*f*, 320*h* extend from the generally diagonal sides 318*b*, 318*d*, 318*f*, 318*h* of the bottom panel 316 and include opposing tabs 324 extending therefrom. The opposing tabs 324 are separated from the remaining portion of the flaps 320*b*, 320*d*, 320*f*, 320*g* by fold lines 326. The width $W_1$ and height $H_1$ of the overall base blank can vary. One specific example is 50½ wide by 58 7/1" high.

In the embodiment of FIG. 17, the bottom panel 316 can further include a collapsible feature 327 comprising a plurality of perforations and cut-outs. The perforations and cut-outs assist a user in collapsing and disposing of the container assembly 310. In the illustrated embodiment, the bottom panel 316 includes two perforated lines 328*a*, 328*b* that intersect at or near the center of the bottom panel 316. A cut-out "X" 330 is formed at the intersection point of the perforated lines 328*a*, 328*b*. The bottom panel 316 further includes tear-out panels 331*a-d* positioned near the diagonal sides 318*b*, 318*d*, 318*f*, and 318*h* of the bottom panel 316. The tear-out panels 331*a-d* are generally bound by a pair of converging perforated lines 332*a,b*, 334*a,b*, 336*a,b*, 338*a,b* generally extending from points near opposing ends of each of the diagonal sides 318*b*, 318*d*, 318*f*, 318*h*. Each of the converging perforated lines 332*a,b*, 334*a,b*, 336*a,b*, 338*a,b* terminates in a cut-out line 340*a*, 340*b*. The cut-out lines 340*a*, 340*b* of each pair of converging perforated lines 332*a,b*, 334*a,b*, 336*a,b*, 338*a,b* are joined by a fold line 342 at one end and by a perforated line 344 at the opposite end.

When a user desires to collapse the container assembly 310 (see FIG. 16), the user may break the perforated lines 34 (e.g., with his or her fingertips), grasp the tear-out panel such that the fold line 342 generally contacts the palm of the user's hand, and pull the tear-out panels 331*a* along the perforated lines 332*a,b*, 334*a,b*, 336*a,b*, 338*a,b*. The user may then push or punch in the center of the bottom panel 316 at the cut-out "X" 330. The bottom panel 316 and, therefore, the container assembly 310, will then be easily collapsed for easy and compact disposal of the container assembly 310.

It is contemplated that a collapsible feature other than the collapsible feature 327 illustrated in FIG. 17 can be incorporated into the base blank (e.g. base blank 313). It is also contemplated that the base blanks of the embodiments of the present disclosure can also be solid (i.e., not including a collapsible feature, perforations, or cut-outs).

Referring now to FIG. 18, the tube blank 315 for forming the container assembly 310 is shown according to one embodiment. The tube blank 315 includes nine side panels 346*a-i*. These side panels include opposed major side wall panels 346*a*, 346*e* of the greatest width $W_8$, $W_{12}$, which can desirably be equal; opposed end wall panels 346*c* and 346*g* of respective widths $W_{10}$ and $W_{14}$, which can desirably be equal and are smaller in with than $W_8$ and $W_{12}$ in this example, and corner wall panels 346*b*, 346*d*, 346*f* and are formed by corner wall forming sub-panels 346*h* and 346*i*; the formed corner walls have widths $W_9$, $W_{11}$, $W_{13}$ and $W_{15}$+$W_{15}$ less the overlap that are desirably equal and smaller than the width of both the side wall panels and the end wall panels. The side panels 346*a-i* are separated by respective fold lines 348*a-h*. The widths of the side wall panels 346*a-g* respectively correspond to the width of the side walls 320*a-h* of the bottom panel 316 of FIG. 17. That is, the side wall panels 346*a*, have widths that allow the assembled tube 312 to fit within the assembled base 310 when the container 310 is assembled with the exterior surfaces of the side walls 346*a-i* abutting the interior surfaces of the adjacent side walls of the base 314. That is, the side walls 346*a*, 346*e* desirably abut the interior surfaces of side wall forming flaps 320*a*, 320*e*; the end walls 346*c*, 346*g* desirably abut the interior surfaces of end wall forming flaps 320*c*, 320*g*; and the corner walls 346*b*, 346*d*, 346*f* and formed by overlapping lower wall forming sections 346*h*, 346*i* desirably abut the interior surfaces of corner wall forming flaps 320*b*, 320*d*, 320*f* and 320*h*. The combined width of the endmost side panels 346*h* and 346*i* in the illustrated embodiment is slightly greater than the width of the side 318*h* of the bottom panel 316. Thus, when the container assembly 310 (FIG. 16) is assembled, the side panels 346*h*, 346*i* overlap such that they may be readily adhered to one another, such as by using adhesive, fasteners and/or a combination thereof.

As can be seen in FIGS. 16 and 18, the major opposed side wall panels 346*a*, 346*e* are each provided with a respective pair of bulge control lines 360*b*, 366*b* for side wall panel 346*a* and 360*a*, 366*a* for side wall panel 346*e*. These bulge control lines are like those shown in FIG. 5. However, they can alternatively be like the bulge control lines discussed herein that mitigate or eliminate spouting; such as, for example, as shown and described in connection with FIGS. 6-15 and 22-24.

In the embodiment of FIG. 18, the tube blank 315 can be made of a single-wall corrugated fiberboard and can include internal reinforcement in the form of a plurality of internal straps 350*a-d* positioned between one of the liner boards and the fluted or corrugated material. The internal straps 350*a-d* may be formed of sesame tape or any other suitable material. It is also contemplated that a different number (i.e., none, one, two, three, or more than four) of internal straps may be used for the tube blank 315. Alternatively, external straps can be used.

The tube blank 315 of FIG. 18, as well as the container blank of FIG. 5 can comprise a plurality of bag holding structures for retaining the upper ends of a liner bag in place in the container. An example of one form of bag holding structure is indicated at 376*a* in FIG. 18. This structure is formed by a diamond shaped pattern of intersecting fold lines 378, 380, 382 and 384 with cuts extending between the intersecting corners of the fold lines to form a cross-shaped cut within the fold lines. An upper portion of the liner can be inserted into the cut and is retained therein by the cut edges. Other alternative forms of bag retaining structures can also be used.

Figure 19:
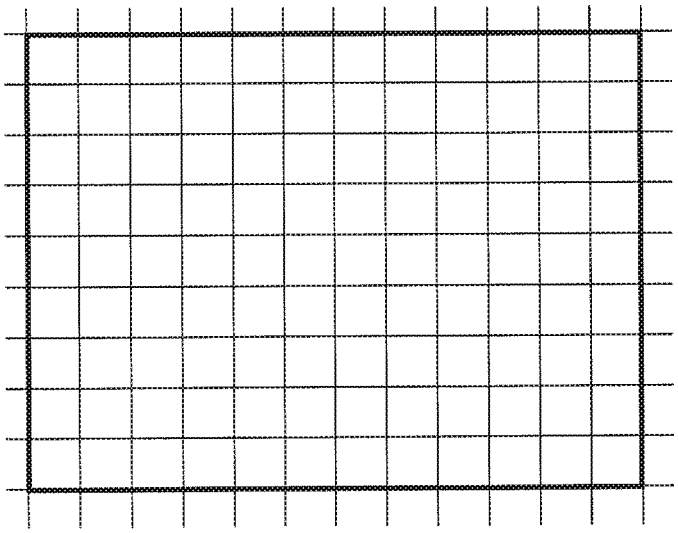
FIG. 19 illustrates a side wall panel of a corrugated paper board container that is twelve units wide by nine units high with no bulge control lines.

The container assembly 310 of FIG. 16 can be assembled using the base blank 313 of FIG. 17 and the tube blank 315 of FIG. 18. To do so, the tube blank 315 can be formed into an octagonal shape such that the endmost side panels 346*h*, 346*i* are aligned and at least partly overlap with one another with enough of the side panels 346*h*, 346*i* not overlapping so as to form a wall of the tube 312. The overlapping portions of the endmost side panels 346*h*, 346*i* may then be attached to one another using any suitable means such as adhesive. The resulting tube portion 312 is shown in FIGS. 16 and 19.

To form the container assembly 310 of FIG. 16, the assembled tube portion 312 is placed over the bottom panel 16 of the base blank 313 (FIG. 17) such that each of the side panels 346*a-g* of the tube portion 312 is adjacent to each of the respective flaps 320*a-g* of the base blank 313. The overlapping side panels 346*h*, 346*i* are adjacent to the flap 320*h* in this example. In one embodiment, adhesive can be placed on the top sides 345 of the flaps 320*a-h* and the tabs 324. Each flap 320*a-h* is then folded toward the tube portion 312 along its respective fold line 320*a-h* such that the adhesive top sides 345 of the flaps 320*a-h* contact and adhere to the respective side panels 36*a-i*. The tabs 324 are then folded along their respective fold lines 326 and adhered to the adjacent side panels 346 of the tube portion 312. As shown in FIG. 19, for example, the tabs 324 of the flap 320*b* are adhered to the side panels 346*a*, 346*c*. The flaps 320*a-h* can alternatively be folded prior to placing the tube portion 312 over the base portion 310 and adhesive can be applied to the outer surfaces of the tube portion so that the base portion and tube portions are fastened together after the tube portion is inserted into the base portion and the adhesive dries.

The resulting double thickness of the base reinforces the corners and vertical scores of the container assembly 310. The integrity of the lower portion of the container assembly 310 is, thus, significantly reinforced.

Reduced Scale Test Results

The term combo or combo bin refers to large-scale bins or containers, such as that can fit a standard palette. The features disclosed herein are not limited to large-scale bin applications. However, the features provide greater benefits in applications where the contents of the bin apply substantial hydraulic forces side walls of the bin.

The contents of meat combining combos are generally flowable. The level of flowability is determined by the leanness of the product. The leaner meat (less fat) tends to be more flowable. The flowability does not appear to be a linear progression as meat greater than 70% lean (beef) tends to hold a significant quantity of purge, making the contents more flowable and subject to significant hydraulic forces. Other products in addition to meat have a liquid content that in effect make them flowable.

Testing Approach

Most of the examples below were explored at half scale (some in ⅔rds or repeated in ⅔rds scale). In half scale the total water weight was 235 lbs roughly a factor of 8 less than typical combo container content weights. The paper board used in the examples varied from 44ECT C-flute to 32ECT (33-26-33) B-flute. The 32ECT B-flute has a bending factor of roughly 10 less than corrugated paper board used in a typical combo container (e.g. 31 SP4+) When ⅔rds scale was used the content weight was a factor of 4 less (500 pounds) than typical full size combo container content weights.

The testing process was the following:

1. CAD cut, erect and palletize the sample container
2. Fill one-eighth to one-fourth full and measure top profile
3. Fill to 250/500 pounds depending on scale
4. Measure top profile without moving
5. Transition to outside and set down (move the pallet with the loaded container)
6. Measure top profile
7. If the results were favorable, commence hydraulic sequence
   a. Up and down movements on fork truck
8. Measure final upper profile This was the basic procedure used in the reduced small scale testing.

Development Work and Results

In the sketches below (with a few exceptions) the black outline or border represents the basic outline of the widest side panel of a combo bin (or in one case a cutline) while the interior lines (inside the border) indicate a scoreline or bulge control line. The term scoreline or bulge control line refers to a compression line formed in the container side wall panel along which the combo bin is encouraged to fold under pressure, such as hydraulic pressure. If there are no interior lines then the illustrated combo bin side wall panel has no bulge guiding lines or control lines. In the sketches below, the top of the side wall is at the upper end of the sketch and the bottom of the side wall is at the lower end of the sketch. The corrugations extended vertically in these examples. The term spouted indicates a failure of the test to contain bulging of the side wall to desired levels (the formation of a spout). The two opposed major (largest width) side wall panels of the test combo bins were provided with the same bulge control lines (if bulge control lines were present). The other side wall panels of the combo bins had no bulge control lines.

Figure 20:
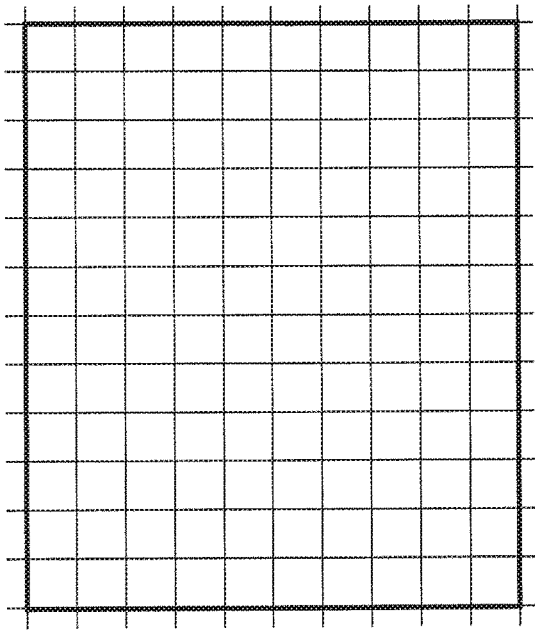
FIG. 20 illustrates a side wall panel of a corrugated paper board container that is ten units wide by twelve units high with no bulge control lines.

In the test embodiments of FIGS. 19 and 20, no bulge control lines were included in the major side wall panels. In FIG. 19, the aspect ratio is twelve units wide by nine units high. In FIG. 20, the aspect ratio was ten units wide by twelve units high. The aspect ratios in the major side wall panels of the test embodiments of FIGS. 21 through 30 was also ten units wide by twelve units high. The side wall panels in FIGS. 19 and 20 test embodiments both spouted.

Figure 21:
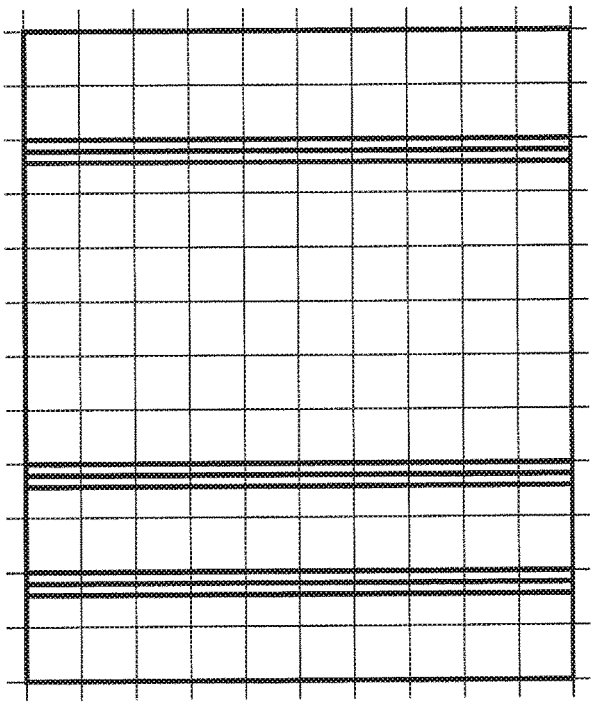
FIG. 21 illustrates a side wall panel of a corrugated paper board container that is ten units wide by twelve units high with no bulge control lines; but with a two sets of three lower straps and a set of three upper straps.

In the test embodiment of FIG. 21, no bulge control lines were provided in the major side wall panels. However, two sets of three straps were positioned along a lower portion of the container and one set of three straps was positioned along an upper portion of the container. This test embodiment also spouted, although spouting was delayed.

Figure 22:
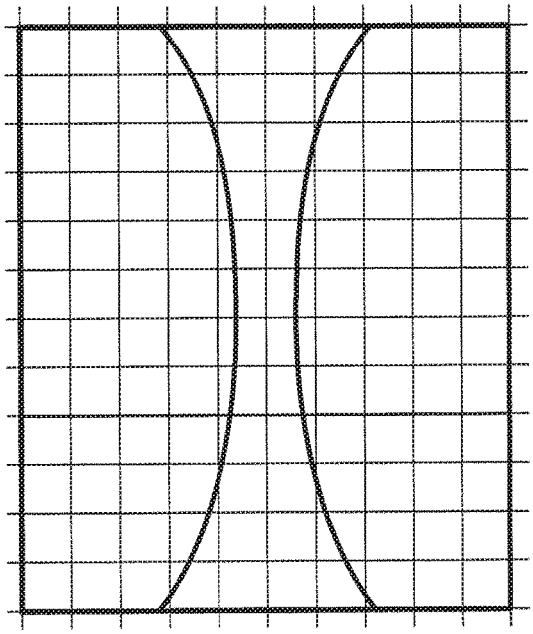
FIG. 22 illustrates a side wall panel of a corrugated paper board container with one form of a pair of bulge control lines extending from the top to bottom edges of the container.

In the test embodiment of FIG. 22, two arcuate bulge control lines were placed in the major side wall panels. These bulge control lines were symmetric about the center of the side wall panels and were each convex relative the closest side edge of the side wall panel. The bulge control lines of this test embodiment extended from the bottom edge to the top edge of the major side wall panels. The result was no spouting.

Figure 23:
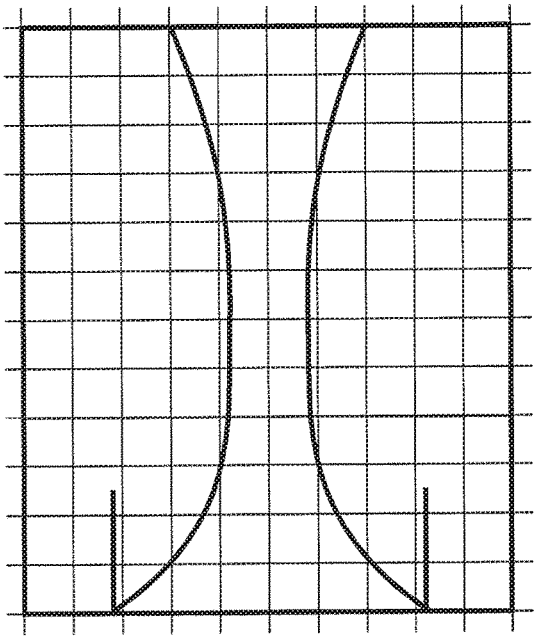
FIG. 23 illustrates a side wall panel of a corrugated paper board container with bulge control lines like those of FIG. 22; but with additional bulge lines extending upwardly from the lower edge of the side wall panel in addition to centrally positioned bulge control lines.
Figure 24:
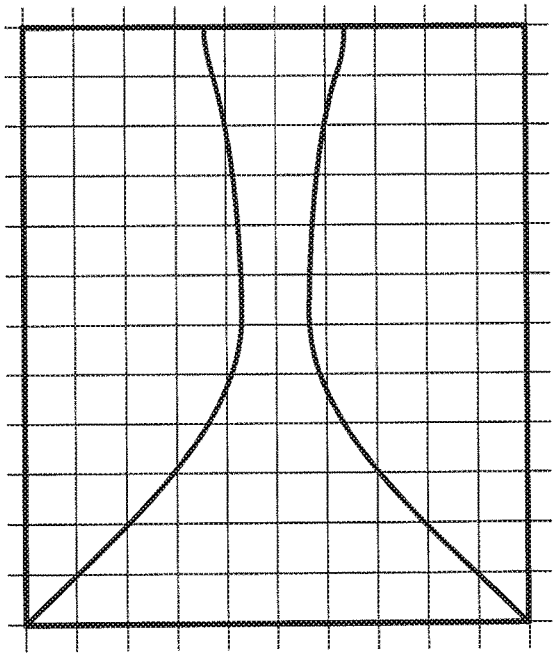
FIG. 24 illustrates a side wall panel of a corrugated paper board container with a further form of bulge control lines.

In the test embodiment of FIG. 23, bulge control lines like those in the test embodiment of FIG. 24 were used. In addition, short bulge control lines extending vertically upward (about two and one-half units) from the bottom of each of the centrally positioned bulge control lines were added. This embodiment also did not exhibit spouting. However, the vertical bulge control lines were not observed in this test to provide any observable benefit. However, during testing bulge control lines that had vertical sections were found to be less beneficial than those that were entirely curved.

In the test embodiment of FIG. 24, the major side wall panels included two arcuate bulge control lines that each were convex relative to the closest side edge of the panel. The bulge control lines each started at a respective lower corner of the side wall panel and converged until the middle section of the panel and then diverged. The distance between the upper ends of the bulge control lines at the upper end of the side wall panel was less than the distance between the bulge control lines at the upper ends of the FIG. 22 test embodiment. The result of this test was no spouting. It was observed that having a bulge control line originating at the lower corners provided a greater resistance to spouting.

Figure 25:
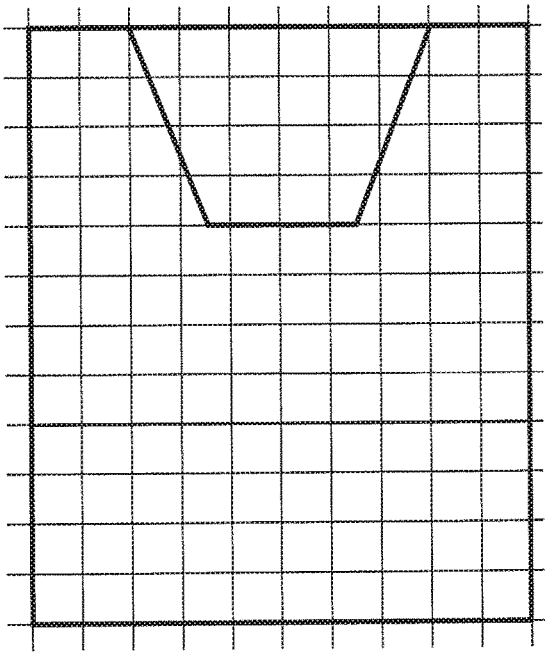
FIGS. 25-31 illustrate side wall panels of a corrugated paper board container with additional forms of bulge control lines that did not prevent spouting when tested.

In the FIG. 25 test embodiment, the bulge control line was trapezoidal and extended from the upper edge of the container to a location above the center of the container. This test embodiment also resulted in spouting.

Figure 26:
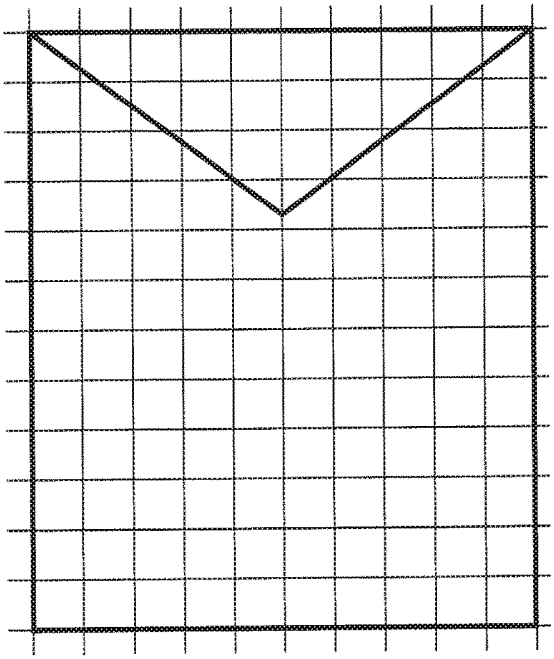

In the FIG. 26 test embodiment, the bulge control line was V shaped and positioned above the center of the container. This embodiment resulted in spouting.

Figure 27:
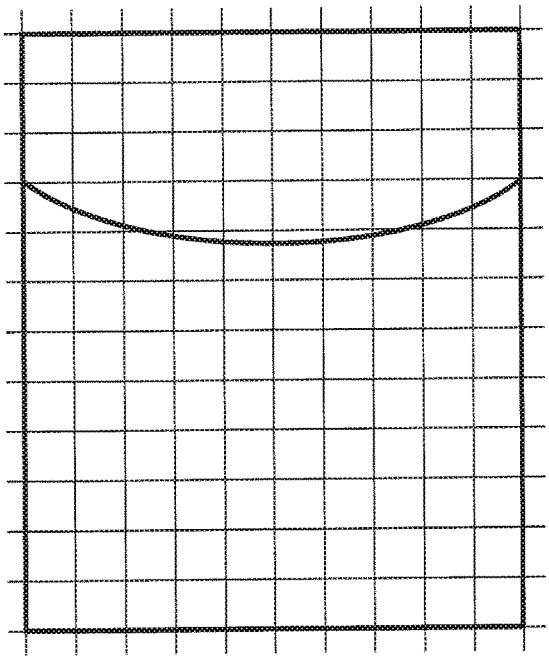

In the FIG. 27 test embodiment, the bulge control line was parabolic (an upward smile shape) and positioned above the center of the container. This test embodiment resulted in spouting.

Figure 28:
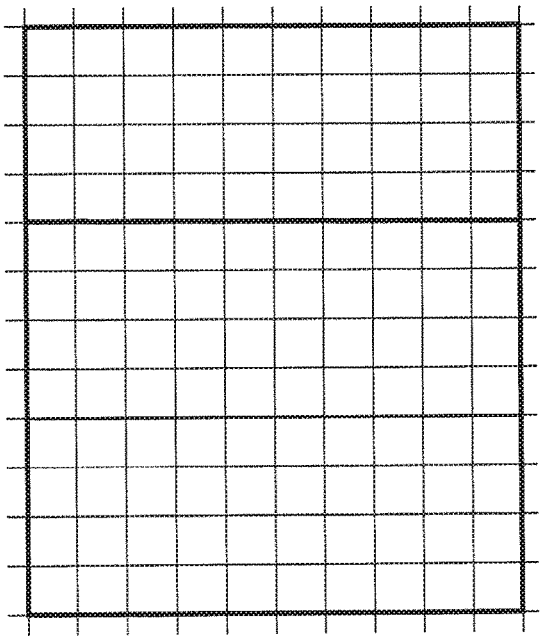

In the FIG. 28 test embodiment, the bulge control line was horizontal and positioned above the center of the container. This design also resulted in spouting.

Figure 29:
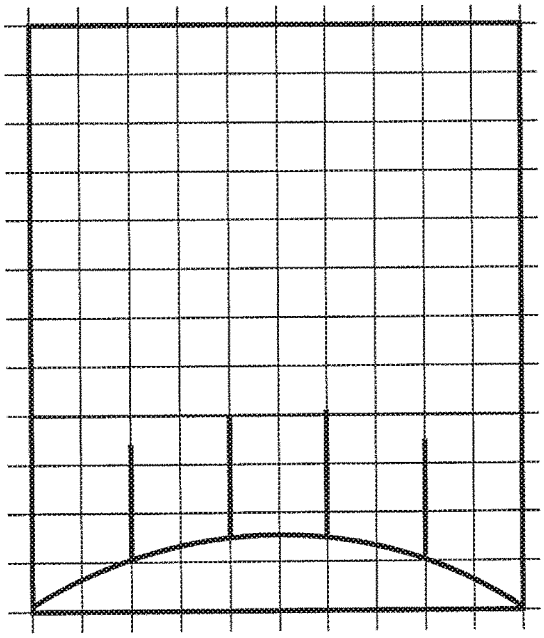

In the FIG. 29 test embodiment, the container also spouted. However, it nearly worked to eliminate spouting. By extending one or more of the vertical bulge control lines to the upper end of the container, or to a location adjacent to the upper end of the container, this test embodiment is expected to eliminate spouting.

Figure 30:
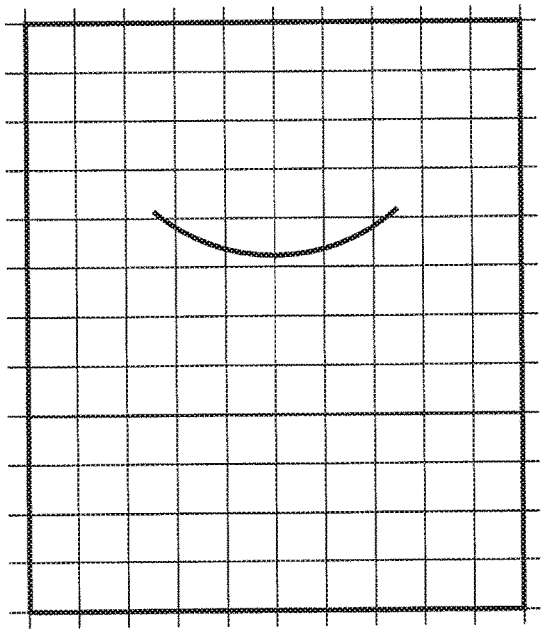
Figure 31:
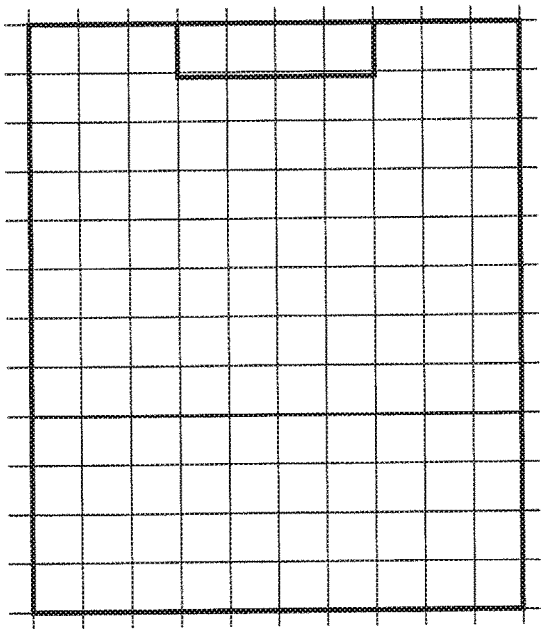

The test embodiment of FIG. 30 used a small parabolic bulge control line positioned above the center of the major side wall panels. This embodiment The test embodiment of FIG. 31 used a u-shaped rectangular bulge control line with vertical legs extending downwardly from the upper edge of the major side wall panels and a horizontal bulge control line extending between the legs at a location one unit from the upper side wall edge. This test embodiment also resulted in spouting of one of the major side wall panels, while the other broke to the ends of the side wall flap defined by the bulge control line.

Observations

- The break in the side wall panel that results in a spout happens very abruptly. Therefore, any likely solution needs to cause the panel to break or crease in its intended location early on.
  - If the panel hasn't broken along a bulge control line by half fill; any break will likely find its own path rather than proceed along a defined bulge line.
  - Even with a score located in a side wall panel, if a break occurs after the container is half filled, it seems that the break is so abrupt and violent that the break often will not find a bulge line.
- The break, while almost instantaneous, seems to originate at the top and shoot down a container side wall panel. This inherently makes sense as the top of the container has no structure to restrain it in the test examples.
- The FIGS. 22, 23 and 24 combo bin examples seem to work because they never really have a stress build up as the side walls start to bulge early on and along the pre-defined path. It appears that if you can get the panel to start to bulge in an intended way early as the combo bin is filled, the bending along the bulge control lines is controllable (handling forces not included).

Throughout this disclosure, when a reference is made to a first element being coupled to a second element, the term "coupled" is to be construed to mean both direct connection of the elements as well as indirect connection of the elements by way of one or more additional intervening elements. Also, the singular terms "a", "and", and "first", mean both the singular and the plural unless the term is qualified to expressly indicate that it only refers to a singular element, such as by using the phase "only one". Thus, for example, if two of a particular element are present, there is also "a" or "an" of such element that is present. In addition, the term "and/or" when used in this document is to be construed to include the conjunctive "and", the disjunctive "or", and both "and" and "or". Unless otherwise expressly indicated, the term "or" shall have the same meaning as "and/or". Examples are described with reference to directions indicated as "above," "below," "upper," "lower," "top", "bottom", and/or the like. These terms are used for convenient description, but do not imply or require any particular spatial orientation. For example, a wall panel described as having an upper and lower edge would be oriented in use with the upper edge of the panel above the lower edge. If the orientation is changed (e.g. a box blank is rotated) such that the lower panel edge is above the upper panel edge, the panel still has the upper edge, even though it is then oriented in a lower position. A location or component is adjacent to a top or bottom edge of a wall panel if it is within ten percent of the greatest distance between the top and bottom edges of the wall panel. The term "about" with reference to a value or characteristic shall mean within plus or minus ten percent of the value, unless otherwise expressly stated. Also, the terms "includes" and "has" have the same meaning as "comprises" and the terms "including" and "having" have the same meaning as "comprising".

Having illustrated and described the principles of this invention with reference to exemplary embodiments, it should be apparent to those of ordinary skill in the art that the embodiments may be modified in arrangement and detail without departing from the principles of this invention. All such modifications are encompassed in this disclosure.

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. We therefore claim as our invention all that comes within the scope and spirit of these claims.

The invention claimed is:

1. A container comprising corrugated paper board, the container comprising:

first and second side wall panels opposed to one another, the container comprising a plurality of other wall panels other than the first and second side wall panels which other wall panels together with the first and second side wall panels are coupled together and form the walls of the container;

a bottom or base portion coupled to the first and second side wall panels and to the other wall panels;

the first and second side wall panels each comprise a panel body including a bottom edge, a top edge, a center between the bottom edge and the top edge, and first and second side edges; and wherein each panel body comprises a plurality of bulge control lines that extend from a first location at or adjacent to the bottom edge of the panel body to a second location at or adjacent to the top edge of the panel body, the bulge control lines subdividing the panel body into at least three subpanels, the bulge control lines extending from the first location to a second location adjacent to the to the top edge of the panel body, and wherein the bulge control lines are further apart at the first location than at a third location that is above the first location, and wherein, between the first location and the second location, the bulge control lines are spaced from a vertical centerline of the panel body.

2. A container according to claim 1 wherein the bulge control lines of each panel body comprise first and second bulge control lines, the first bulge control line comprising a first bulge control line section below the center of the panel body and the second bulge control line comprising a second bulge control line section below the center of the panel body, wherein the first and second bulge control line sections converge along a least a portion of the length of the respective first and second bulge control line sections moving away from the bottom edge and upwardly toward the center of the container.

3. A container according to claim 1 wherein the first and second bulge control line sections are arcuate.

4. A container according to claim 2 wherein the first bulge control line comprises a third bulge control line section above the center of the panel body and the second bulge control line comprises a fourth bulge control line section above the center of the panel body, wherein the third and fourth bulge control line sections diverge along at least a portion of the length of the of the respective third and fourth bulge control line sections moving away from the center and toward the top edge.

5. A container according to claim 4 wherein the first, second, third and fourth bulge control line sections are arcuate.

6. A container according to claim 2 wherein each panel body comprises first, second, third and fourth corners, the first corner being at the intersection of the of the first side edge and the bottom edge, the second corner being at the intersection of the second side edge and the bottom edge, the third corner being at the intersection of the first side edge and the top edge and the fourth corner being at the intersection of the second side edge and the top edge, wherein the first bulge control line section extends upwardly and from the first corner and the second bulge control line section extends upwardly from the second corner.

7. A container according to claim 1 wherein the first and second bulge control lines are arcuate, are spaced apart from one another at the center of the panel body, are at opposite sides of the vertical centerline of the panel body, and extend from the bottom edge to the top edge of the panel body.

8. A container according to claim 1 wherein at least a portion of the first and second bulge control lines below the center of the panel body are arcuate.

9. A container according to claim 1 wherein each panel body comprises first and second bulge control lines, the first bulge control line extending upwardly from a first bulge control line first location to a first bulge control line second location, the second bulge control line extending upwardly from a second bulge control line first location to a second bulge control line second location, each panel body further comprising first, second, third and fourth corners, the first corner being at the intersection of the of the first side edge and the bottom edge, the second corner being at the intersection of the second side edge and the bottom edge, the third corner being at the intersection of the first side edge and the top edge and the fourth corner being at the intersection of the second side edge and the top edge, wherein first bulge control line first location is at the first corner and the first bulge control line second location is at the top edge, and wherein the second bulge control line first location is at the second corner and the second bulge control line second location is at the top edge.

10. A container according to claim 9 wherein the first bulge control line second location is spaced inwardly along the top edge of the panel body from the third corner and the second bulge control line second location is spaced inwardly along the top edge of the panel body from the fourth corner.

11. A container according to claim 2 wherein the first and second bulge control lines are mirror images of one another.

12. A container according to claim 1 wherein each panel body comprises an interior surface which faces the interior of a container and wherein, the first and second bulge control lines are formed in the interior surface of each wall panel body prior to filling the container with contents.

13. A container according to claim 1 wherein the first and second side wall panels are wider than the other wall panels and the other wall panels do not have bulge control lines.

14. A container according to claim 1 wherein the other wall panels include four corner wall panels each with first and second corner wall panel side edges, and first and second end wall panels each with first and second end wall panel side edges, a first of the corner wall panels having its first corner panel side edge connected to the first side edge of the first side wall panel and its second corner panel side edge connected to the first side edge of the first end wall panel, a second of the corner wall panels having its first corner panel side edge connected to the second side edge of the first side wall panel and its second corner panel side edge connected to the first end wall side edge of the second end wall panel, a third of the corner panels having its first corner panel side edge connected to the first side edge of the second side wall panel and its second corner panel side edge connected to the second side edge of the first end wall panel, and a fourth of the corner panels having its first corner panel side edge connected to the second side edge of the second side wall panel and its second corner panel side edge connected to the second end wall side edge of the second end wall panel, wherein the first and second wall panels have a greater width than the width of the first and second end wall panels.

15. A container according to claim 14 wherein the first and second end wall panels have a greater width than each of the four corner wall panels.

16. A container according to claim 14 wherein the first and second bulge lines are spaced apart such that the width between the first and second bulge lines at the center of the wall panels is not greater than the width of the end wall panels.

17. A container according to claim 14 wherein the first and second bulge lines are spaced apart and the width between the first and second bulge lines at the center of the wall panels is not greater than the width of the corner wall panels.

18. A container according to claim 1 wherein the other wall panels comprise four corner wall panels each with first and second corner wall panel side edges, and first and second end wall panels each with first and second end wall panel side edges; wherein a first of the corner wall panels has its first corner panel side edge connected to the first side edge of the first wall panel and its second corner panel side edge connected to the first side edge of the first end wall panel, a second of the corner wall panels has its first corner panel side edge connected to the second side edge of the first wall panel and its second corner panel side edge connected to the first end wall side edge of the second end wall panel, a third of the corner panels has its first corner panel side edge connected to the first side edge of the second wall panel and its second corner panel side edge connected to the second side edge of the first end wall panel, and a fourth of the corner panels has its first corner panel side edge connected to the second side edge of the second wall panel and its second corner panel side edge connected to the second end wall side edge of the second end wall panel, wherein the width of the subpanel between the first and second of the bulge control lines at the center of the first and second wall panels is no greater than the width of the first and second end wall panels; and wherein the container comprises a base or bottom portion.

19. A container according to claim 18 wherein the first and second end wall panels have a greater width than each of the four corner wall panels.

20. A container according to claim 18 wherein the base or bottom portion comprises a plurality of bottom flap panels extending from the lower edges of the side wall panels, the end wall panels and the corner panels, and wherein the container does not have top flap panels extending from the upper edges of the wall panels.

21. A container according to claim 18 wherein the side wall panels, the end wall panels, and the corner panels form a tubular container wall structure, and wherein the base or bottom portion comprises a base coupled to the tubular wall structure.

22. A one piece blank for forming the container of claim 1, the blank comprising the first and second side wall panels with the bulge control lines of claim 1 and the other wall panels of the container of claim 1.

23. A first one piece blank for forming the first and second side wall panels with the bulge control lines and the other wall panels of the container of claim 1 and a second one piece blank for forming the bottom or base portion of the container of claim 1.

24. A container comprising corrugated paper board, the container comprising:

first and second side wall panels opposed to one another and that are in respective first and second planes, the container comprising a plurality of other wall panels other than the first and second side wall panels which other wall panels together with the first and second side wall panels are coupled together and form the walls of the container;

a bottom or base portion coupled to the first and second side wall panels and to the other wall panels; and wherein the first and second side wall panels each comprise means formed in the first and second side wall panels prior to filling the container with contents that extend from a location at or adjacent to a bottom edge of the first and second side wall panels to a location at or adjacent to the upper edge of the first and second side wall panels for subdividing the side wall panel into at least three upright subpanels that bulge out from the respective first and second planes and that each extend from the bottom to the top of the container as the container is filled with contents, and wherein, between the first location and the second location, said means formed in the first and second side wall panels prior to filling the container are spaced apart from one another.

25. A wall panel for a corrugated paper board container comprising:

a panel body comprising corrugated paper board including a bottom edge, a top edge, a center between the bottom edge and the top edge, and first and second side edges;

the panel body comprising a plurality of bulge control lines that extend from a location at or adjacent to the bottom edge of the panel body to a location at or adjacent to the top edge of the panel body, the bulge control lines subdividing the panel body into at least three subpanels that extend from a location at or adjacent to the bottom edge of the panel body to a location at or adjacent to the to the top edge of the panel body, and wherein, between the first location and the second location, the bulge control lines do not intersect one another; and wherein the bulge control lines comprise first and second bulge control lines, the first bulge control line comprising a first bulge control line section below the center of the panel body and the second bulge control line comprising a second bulge control line section below the center of the panel body, wherein the first and second bulge control line sections converge along a least a portion of the length of the respective first and second bulge control line sections moving away from the bottom edge and upwardly toward the center of the container.

26. A wall panel according to claim 25 wherein at least the first and second bulge control line sections are arcuate.

27. A wall panel according to claim 25 wherein the panel body comprises first, second, third and fourth corners, the first corner being at the intersection of the of the first side edge and the bottom edge, the second corner being at the intersection of the second side edge and the bottom edge, the third corner being at the intersection of the first side edge and the top edge and the fourth corner being at the intersection of the second side edge and the top edge, wherein the first bulge control line section extends upwardly from a first location at or adjacent to the first corner and the second bulge control line section extends upwardly from a second location at or adjacent to the second corner.

28. A wall panel according to claim 25 comprising an interior surface which faces the interior of a container with the wall panel, the first and second bulge control lines being formed in the interior surface of the wall panel.

* * * * *